US006659882B2

(12) United States Patent
Patsky

(10) Patent No.: US 6,659,882 B2
(45) Date of Patent: Dec. 9, 2003

(54) GOLF CLUB WITH A HEAD BALANCE PLANE HAVING MULTIPLE SWEET SPOTS AND FACE AND TOP MARKINGS AND METHODS AND TOOLS FOR LOCATING SAME

(76) Inventor: Bernard J. Patsky, 24 Beverly Hill Dr., Shrewsbury, MA (US) 01545-5812

( * ) Notice: Subject to any disclaimer, the term of this patent is extended or adjusted under 35 U.S.C. 154(b) by 0 days.

(21) Appl. No.: 09/797,357

(22) Filed: Feb. 28, 2001

(65) Prior Publication Data

US 2001/0009872 A1 Jul. 26, 2001

Related U.S. Application Data

(63) Continuation-in-part of application No. 09/225,101, filed on Jan. 4, 1999, now Pat. No. 6,224,494.

(51) Int. Cl.[7] ..... A63B 53/04

(52) U.S. Cl. ..... 473/292; 473/324; 473/349; 473/409

(58) Field of Search ..... 473/292, 251–255, 473/314, 324, 330, 331, 349, 409

(56) References Cited

U.S. PATENT DOCUMENTS 723,534 A * 3/1903 Knight
D55,278 S * 5/1920 Kraeuter
D57,980 S * 5/1921 Kraeuter
1,511,479 A * 10/1924 Kelly
2,005,401 A * 6/1935 Storz
2,034,936 A * 3/1936 Barnhart
2,880,002 A * 3/1959 Wetty
D185,522 S * 6/1959 Whitney
3,595,577 A * 7/1971 Hodge
4,527,799 A * 7/1985 Solheim
4,529,203 A * 7/1985 Ribaudo
5,029,865 A * 7/1991 Kim
5,505,450 A * 4/1996 Stuff
5,785,610 A * 7/1998 Birmingham
6,048,277 A * 4/2000 Raymond
6,267,690 B1 * 7/2001 Salmon
6,348,010 B1 * 2/2002 Doolen

* cited by examiner

*Primary Examiner*—Stephen Blau
(74) *Attorney, Agent, or Firm*—James F. Baird, Esq.

(57) ABSTRACT

An improved golf club head consisting of a balance plane that derives markings visible on the club head face indicating the ideal points of contact with a golf ball regardless of whether the golf ball is lying on the ground, on a golf tee or otherwise, together with markings visible on club head top indicating basic alignment of club head and golf ball to the target, with methods and tools for determining same. The markings are determined by intersecting lines, planes and axes. The markings may be determined for an existing golf club or for a custom fitted golf club regardless of whether the golf club has a flat or curved base. The location of the markings may vary from golfer to golfer and from club to club depending upon parameters.

14 Claims, 21 Drawing Sheets

GOLF CLUB WITH A HEAD BALANCE PLANE HAVING MULTIPLE SWEET SPOTS AND FACE AND TOP MARKINGS AND METHODS AND TOOLS FOR LOCATING SAME

This Application is a Continuation in part of application Ser. No. 09/225,101 filed on Jan. 4, 1999 now U.S. Pat. No. 6,224,494.

BACKGROUND OF THE INVENTION

Since the beginning of golf in the 1400's, Golf club manufacturers say there is a Sweet Spot and Center Of Gravity on clubheads that has been understood, assumed and accepted by all golfers, but why haven't they told us golfers where that Sweet Spot is designed for, to hit a ball off the Ground or perched on a Tee? Wherein this disclosure unveils and tells golfers how this is to be accomplished.

Golf club manufacturers and golfers have been trying, but unable to solve golfs 600 year old riddle of hook and slice, wherein they lay awake at night trying to figure out how to hit a golf ball straight . . . until now.

A Golf Club, Golfclub, Club, or Clubhead, is considered complete with all of its components, Grip, Shaft and Head. A Club head is a component part of a Golfclub.

The past recorded knowledge and recognition of a clubhead having a center of percussion, otherwise known as a Sweet Spot, and a Center Of Gravity will be proven to be not applicable because it does not take into consideration the shaft and the grip, which is antiquated, and circumvented by this patent, which divulges the existence of a Golf clubhead Sweet Line containing two main points at which to strike a ball, or Two Sweet Spots, and its associated derivatives, found by the use of a balance plane.

There are four basic categories to improve playing golf, the golfer, their equipment, technique and prayer. Their search for the correct equipment, or the ultimate golf club, is like looking for the needle in the haystack, or that one Sweet Spot on a clubhead with which to hit the ball. In the past, there has been no correct method of finding, understanding or knowing how to use this Sweet Spot on a golf club, until now.

The Golf club strikes a ball at a master reference point called the Ball Impact Point, which can be a variable dependant upon the club design or use, and in regards to basically two ball height positions, being a ball on the ground and/or a ball on a tee.

A golf clubhead is like a wrecking ball which has a cable or chain that controls three basic parameters, speed, power and direction, with the wrecking ball doing all of the work. A clubhead does more, it controls loft, tilt, ball spin, direction, control, etc. The clubhead works in conjunction with the shaft whereas the wrecking ball is independent of the cable or chain. A golf clubhead is similar to an airplane. During landing the airplane wings must always be parallel to the ground. Likewise a golf clubhead must be in the specific design position.

A golf club is similar to a humans leg, the Grip vs. Thigh, Shaft vs. Calf, and the Clubhead vs. Foot, whose clubhead comparison consists of a Toe, Heel and Sole. If a foot is not soled properly it will affect ones ability to walk, likewise if the clubhead is not soled properly, a change will occur altering the characteristics of the clubhead, as this disclosure will explain. Likewise, a clubhead is also comparable to a barbell that has a Sweet Spot and a Center Of Gravity, wherein if one end of the barbell is lifted higher than the other end, the sweet spot and center of gravity changes. Therefore, if the clubhead Toe or Heel goes up, it alters the soling and moves that now questionable sweet spot one way or the other, causing miss hits.

All golf clubs to date have round bases to accommodate the majority of golfers lie angles.

Forward Press, or Positive Press, is the tilt of the shaft positioning leaning towards the target or hole, normally from center body, allowing the shaft to be more in line with the golfers forward arm. Forward Press keeps the forward wrist straight which can be adapted to specific golf clubs to create a Press Rhythm resulting in similar setup and use that provides optimum power, control and direction between all clubs. Reverse Press or Negative Press is the movement or the tilt of the shaft away from the target. Press Deviation is more detrimental to the golfer than Lie Angle Deviation. Press is measured in inches, mm or degrees.

Hooding is the instability of the clubhead causing it to wobble, flounder or flop over, resulting in the opening or closing of the clubhead face, when it is not in its designated position or limits that are designed basically for lie or press angles. Hooding affects are related to the soling of that clubhead, which is more prolifically felt when soled on a smooth flat surface, compared to being on a rug or grass. All clubheads produced have curved or arced bases with a soled radius, like a seesaw or rocking chair, to generically fit every golfer, that gives the illusion of identical soling, whereby changing the sweet spot location, without necessarily Hooding. Hood design in clubheads will alert the golfer that a parameter change exists, that will alter the ball striking characteristics of the clubhead, so that he may make necessary adjustments. This patent is also applicable to all clubhead bases that are of such a curved nature or otherwise, that can incorporate an Automatic Hood feature.

This inventor has established Three Triangles in golf, the Stance Triangle, the Alignment Triangle, and the Club Triangle, that can affect the Sweet Line and dependency upon the Ball Impact Point.

These triangles are generally applicable in life and sports, such as baseball, golf, bowling i.e.

The Stance Triangle requires the ball, golf club and player be in a referenced and repeatable position. This triangle is derived from three points, the Ball Impact Point, the positioning of the grip top with the players hand or Press, and the distance from the players forward foot tip to the imaginary ball traveling line called the Foot distance. The perpendicular distance from the tip of the forward foot to a projected clubhead face line is called the Ball distance. Each individual club has its own characteristics that the golfer must adapt in his Stance Triangle for that club, requiring reproducibility each time that club is used, otherwise the Sweet Line changes. This triangle will always remain the same when the ball, and the golfers feet are on the same plane, but, If they are on different planes, then the Stance Triangle must change.

The Alignment Triangle requires the ball, golf club and player in position. This triangle is derived from three points, the Ball Impact Point, the Foot distance and the positioning of the bridge of the golfers nose. This triangle is used to align the clubhead and Ball Impact Point in relationship to the target.

The Club Triangle is derived by three dimensions, length and two plumb bob measurements, when the clubhead is in its intended position. The length of the club is normally measured along the shaft centerline from the grip top to a point on the ground with the golfclub in its' intented use position. The length of the club should be measured from the top of the grip to the clubhead base, vertically below the intended clubhead impact point, in consideration to the correct golf club intended use. A plumb bob hanging from grip, creates two distances, one from the imaginary ball line, and the other from the club head face line. These triangular methods are used in conjunction with the golfers Stance Triangle, and applicable to the manufacture of custom clubs, club duplication, and to verify club parameters if it is suspected of being damaged, or otherwise. The clubhead soling is extremely important and will be analyzed and discussed later.

Iron Head face heights vary, by peaking adjacent to the toe, being angularly and diminishing in height, being flat or somewhat curved, and terminating at the heel or shaft. Whereas Wood Head tops are curved horizontally and peak near the toe or at the center above the head Sweet Spot. Both will be shown to be substantially improved.

Impact areas on Iron Head faces are flat, whereas Wood faces incorporate a curved horizontal face bulge and vertical face roll, having both identified with Sweet Spot markings. External to the impact areas, Woods and Iron Heads sometimes have alignment markings, referenced to the Head Center Of Percussion Sweet Spot or Center Of Gravity, which have been designed without taking into consideration the Grip and Shaft components, wherein, this patent does take into consideration these components.

Golf club shaft mounting into the head heel has moved from basically in line with the face, to ahead of the face towards the hole called Offset, wherein presented is the movement back, called Centerset, or having the shaft centerline referenced to the Two Sweet Spots, or opposite the head center.

Presented are the four states that an object resides in, Static State, Dynamic State, Dynamic Impact State and Dynamic Impact Aftermath State.

In a Static State, any instrument, including a baseball bat, golf club or Head component, having no motion, and not subjected to external forces, are only affected by gravity. In this state, all objects, Symmetrical and Nonsymmetrical have a Center of Gravity. This patent is in agreement, that on all Heads, without their shaft and components, and in their Static State, have a Center of Gravity from where a Sweet Spot can be deduced and identified. That a Head, Center Of Gravity and Sweet Spot is one thing, but components must be added to the Head to make a golf club, resulting in the golf clubs own Center of Gravity that is now in free space, caused by related club planes, axes and weighting, that must be taken into consideration to understand the design of the Two Sweet Spots, by its derivation and derivatives.

A Dynamic State is created when that instrument is subjected to external forces that causes it to move and defy gravity, as in the case of a complete golf club with all of its components being swung, that now takes into account Center Of Mass, Swing Plane and centrifugal forces. Thus, the past terminology relating to center of gravity will be replaced by Center Of Mass.

A Dynamic Impact State is created when that instrument or golf club in the Dynamic state strikes or hits an object in a Static or Dynamic State, such as a ball, that can be measured during contact, or dwell time, on both the instrument and struck object. When a Nonsymmetrical instrument, such as a golf club, is used in a Dynamic Impact State, gravitational forces are overcome and become virtually insignificant resulting in new phenomena and terminology, as will be described and discussed in this disclosure.

A Dynamic Impact Aftermath State occurs to both the instrument and struck object after contact is completed.

The Clubhead Swing Plane has been extremely skewed on past clubheads, that will be shown to have a prolific improvement.

A player swinging any instrument, whether a baseball bat or golf club, creates an extension of the Swing Plane with his arms and body, somewhat controlling any miss hits to an object by the gripping power with his hands, but the instrument is still the prime controlling factor in the Dynamic Impact State, with the clubhead being paramount as the striking force.

Many years ago rifles had no gun sights for alignment purposes, but today all rifles, pistols and derringers have two gun sights that can also be adjusted to distance targets, so why not a golf club having Target Lines for alignment, and Two Sweet Spots to coincide to the two ball height distances, from the Ground or off a Tee.

INVENTION OBJECTIVES

To introduce several novel features that is applicable to all existing and future classifications of instruments, especially golf clubs, that are intended to make contact with another object, ball or otherwise.

To establish and promote correct golf club use, and testing, through the understanding and knowledge of modern golf club design technology using the Sweet Line principles derived from a balanced plane within the clubhead.

To overcome the mandated Sweet Spot belief, known throughout the centuries, wherein on clubheads there exists only one singular sweet spot derived from a head center of gravity, and to unveil this myth by conveying to golfers that what actually exists is a clubhead balance plane having an angular Sweet Line with Two Sweet Spots for hitting a ball on the ground and off a tee.

To pass on to my fellow golfers, my twenty five years of frustration in golf before my father said "You're an Engineer . . . FIX IT!".

SUMMARY OF THE INVENTION

This patent does not take into consideration, nor is necessarily concerned with, prior patents, nor any other documentation, discussing, and interpreting a Sweet Spot as being the point at which to hit a golf ball. The Sweet Spot has also been interpreted as that One Singular Point, Center of Gravity, Center Point, Geometric Center, Center of Compression, Point of Compression, Center of Percussion, Impact Point, etc., which past golf club design concepts and principles were based upon, that are hereby repudiated, and justifiably so, by this disclosure.

This patent encompasses new engineering design principles in golf clubs, their manufacture and fitting, applicable to alignment markings and identification at any clubhead location, on or within the clubhead, adjustable or fixed, within or external to the impact area as defined by the USGA or other entities, visual or nonvisual, color coded, blended or otherwise, singular or plurality, and in any mannerism, allowing the golfer to automatically and exactly align the clubhead to a ball at any height, but basically at two heights, from the Ground or perched on a Tee, whereupon at ball impact results in the transferral of optimum power, control and direction of intent. In order to accomplish this, correct soling of the clubhead base should be made but is not necessary.

This present invention applies to all Symmetrical and Nonsymmetrical instruments that are used to hit an object. A comparison will be made between two instruments, a Symmetrical baseball bat and a Nonsymmetrical golf club, that are used to hit an object baseball or golf ball, to simplify the understanding of the mechanics and physics principles involved in their operation and differences, wherein both have a Swing Plane and other similarities.

A golf club has a Swing Plane, that projects through the clubhead called the Clubhead Swing Plane and whose Perimeter Line is called the Bernie Line. The Swing Plane also facilitates a Swing Plane Arc, Swing Plane Radius, Swing Plane Radius Length, and Center Of Mass Axis. The Bernie Line is the missing link in clubhead design that opens a new door in golf, wherein evolves many new reference derivations that will be identified and easily understood through analogies in this disclosure. The Clubhead Swing Plane can result in being much less skewed in this endeavor.

Each clubhead has its own individual Bernie Line that consists of three major subdivision lines, Sweet Line, Target Line and the Training Line.

The Sweet Line is located angularly on the clubhead face that contains the Central Axis Of Power offering a number of Infinite Sweet Spots that subdivides into Six Sweet Spots called the Maximum Sweet Spot, Optimum Sweet Spot, True Sweet Spot or Huzza Point, Ground Sweet Spot, and the Tee Sweet Spot. The Six Sweet Spots can be interrelated. The Sweet Line and the Balance Plane may not be symmetrical.

The True Sweet Spot is associated with clubheads designed to hit a Ball Impact Point, primarily from one reference point, such as the ground, that can be any combination of the Six Sweet Spots, or of a general independent or reference nature. The True Sweet Spot can be used to strike a ball at another height if the club lie angle is altered. The True Sweet Spot is a variable.

The Sweet Line, and derivatives, can be installed on clubhead faces incorporating bulge, roll, curved, flat, otherwise or any combination thereof. Examples, the Sweet Line can incorporate bulge and roll, being called Sweet Line Angular or Diagonal Face Bulge and Sweet Line Angular or Diagonal Face Roll, or having a Flat Sweet Line with the remainder of the face incorporating bulge and roll, or be flat faced, etc.

The angled Sweet Line is primarily referenced to two ball height resting locations, that being on the Ground or perched on a Tee, respectively called the Ground Sweet Spot and the Tee Sweet Spot, resulting in the term Two Sweet Spots, that are laterally apart necessitating a lateral movement of the clubhead alignment to the ball, that is dependant upon clubhead soling.

The available length on the Sweet Line to efficiently hit a ball at these two ball heights is measured from the Maximum Sweet Spot to the Ground Sweet Spot, or the Tee Sweet Spot, being respectively called the Ground Hit Line or the Tee Hit Line, that is also respectively measured vertically from the ground and called the Ground Sweet Spot Height and Tee Sweet Spot Height. The nonavailable area to hit a ball on the Sweet Line is called the Ground Dead Line or Tee Dead Line.

The Two Sweet Spots, Ground Sweet Spot and Tee Sweet Spot, can then be translated into vertical lines, or otherwise, on or external to the face impact area, being respectively called the face Ground Vertical Line and Tee Vertical Line, that can have the face grooves or markings referenced and designed accordingly.

From the Ground Vertical Line and Tee Vertical Line we can then derive top clubhead markings respectively called the Ground Target Line and Tee Target Line directions, that results in the Automatic Alignment and aiming of the clubhead to the ball with the direction of intent to the target, thus being referenced to the two ball heights.

Color coding can then be adapted with the Ground Target Line identified in green as the color of grass, and the Tee Target Line identified in white as in the standard color of a tee, whereby both visually indicates, and correlates to the golfer, instant and complete Color Coded Target Alignment for ball height and direction. These target direction lines can be referenced to the Target Line but may, or may not be parallel nor in straight lines, depending upon clubhead design and construction.

The Training Line, or associated lines, can be identified on the nonvisual, bottom or backside portion of the clubhead, that when inverted into the bag identifying that club as having the Bernie Line concepts, and is also used in club design, swing analyzing training aid, etc.

The aforementioned information is applicable to all clubheads, but, if the clubhead is not soled properly, a change in the Sweet Line angulation, being either more vertical or horizontal will affect all other associated parameters, and the use of the club. To correct this situation, clubs may incorporate different parameters such as lie, press, etc., that can be generically produced within these confines by the manufacturers, or be fitted exactly to the golfers individual Sweet Line derivatives. Once a Sweet Line and its derivatives are fitted to a golfer, the odds are against anyone else using that club. Unfortunately, all past clubs have been difficult to exactly fit to a golfer because their sole is cambered, arced, soled radius, etc., which may seem flat, but is actually an illusion.

Each club can be optimized in use by having repeatable Flat Base soling, along with other parameters, that establishes correct face orientation and alignment of the club to the ball and target, in reference to the golfers position. By having a Flat Base clubhead, fitted to the golfers Stance Triangle with a constant Sweet Line, results in optimum benefits to the golfer, but only if that flat soling can be felt to change when not flat, that alerts the golfer that the Sweet Line has changed.

Thus, a further improvement of the Flat Base is to connect a Hood Point which is sharp, or curved at the toe or heel, that becomes Automatically Hooded when used in a mannerism in which it was not designed for. Hence, when another golfer tries to use that club in their own Stance Triangle it becomes Automatically Hooded. A Hood Limit prevents the clubhead from completely flopping over.

Golf clubs that are design to hit a ball at one height that's on the Ground coinciding with a True Sweet Spot, can facilitate a Second Base to allow hitting a ball off a Tee with Automatic Loft.

A Heel Base further allows the golfer to broaden the Two Sweet Spot and the Lateral Displacement of the club, conversely a Toe Base brings the Two Sweet Spots closer together reducing the Lateral Displacement. Either bases can be used for an uphill or downhill lie.

Moving the shaft position physically back in the clubhead, away from the face, opposite the clubhead center or any proximity thereof, is called Centerset, that can be used in clubhead weight distribution balancing.

Golfer eyes position, in relationship to the ball or clubhead, are normally found between vertical, and to an angular displacement of approximately thirty degrees. Conventionally woods, for example, have their crowned shaped head tops basically parallel to the ground, wherein if the Ground Target Line and or Tee Target Line are identified on these clubheads they will be distorted to the golfers eyes due to parallax and depth perception. This can be overcome with an EyeAligner that has the clubhead top, or an alignment mechanism, that faces the golfers eyes squarely, enabling him to automatically align to the ball.

The height of a clubhead face need not ever be higher than the equator of the ball, taking into account the balls compression and slip, loft, height, etc., unless the clubhead contacts the ground first. The height, or valley, can be concentrated in any mannerism to the Sweet Line, and called Sweet Spot Peak, that locates the optimize height of the clubhead or face with which to hit a ball.

Some clubs are intentionally used to make contact with the ground after ball impact. If the clubhead makes contact with the ground prior to the hit or during the dwell time, the clubhead will contort and alter the Sweet Line characteristics. This can be minimized by altering the face base of the clubhead to be sharp allowing the clubhead to Plow or Plow Through the ground that will offer minimum resistance, reduce clubhead bounce and other related stresses. The Plow can be an integral part of the Flat Base and extend into the Toe and Heel areas that will also contact the ground.

Since a small percentage of ball hits occur on the intended Two Sweet Spots or True Sweet Spot, clubhead design considerations are dependant upon balance clubhead parameters that relies upon influencing planes and axes within the clubhead to minimize losses.

There are Two Club Planes in a golf club that intersect, the Swing Plane and the Face Orientation Plane, not taking into account Control Mass or Orbital Mass that subdivides in equal masses. The Control Mass dominates from the Swing Plane to the heel, whereas the Orbital Mass dominates from the Swing Plane to the toe. The Control Mass, compared to its counterpart has less hitting area, more bell shaped with narrower sigma limits.

There are up to Five Clubhead Planes, Clubhead Swing Plane, Clubhead Face Orientation Plane, Clubhead Weight Distribution Plane, Ground Sweet Spot Plane, and Tee Sweet Spot Plane.

There are up to Five Clubhead Axes, the Center Of Gravity Axis, Clubhead Central Axis, True Sweet Spot Axis, Ground Sweet Spot Axis, and Tee Sweet Spot Axis.

These planes and axes are interrelated and arced during ball impact, wherein any three, or more, intersecting combinations create a master reference called the Bernie Point.

There are two main Power Distribution Curves, the Sweet Line Power Curve, and the Weight Distribution Face Line Power Curve that can be statistically plotted, in conjunction with the weight balancing of the Four Face Quadrants, called the upper, lower, toe and heel quadrants, with the respective curves called, for example, the Upper Toe Power Curve. The ideal resultant four quadrant bell shaped curves will be similar, less skewed, flatter, and with wide sigma levels with this patent.

The Clubhead Weight Distribution Plane has a Weight Distribution Face Line that has an angular limit between below horizontal and near vertical.

Clubhead weight distribution is of prime concern, for example, the more Lower Toe Weighting, and Less Heel Weighting, results in a more horizontal angle of the Sweet Line, that separates the Ground Target Line from the Tee Target Lines allowing more lateral movement of the clubhead between these lines, whereas, Upper Toe Weighting results in a more vertical angle that can result in the Weight Distribution Face Line being perpendicular to the Sweet Line.

These clubhead planes and axes divide up into eight quadrants that can form any angular relationship by weight distribution. One position will be shown when all planes and axes are at ninety degrees to each other, having better balancing forces, all in relationship with the True Sweet Spot. Another position will be shown when the Clubhead Weight Distribution Plane is horizontal.

Clubhead stability is enhance by a Quadrant Weight Distribution system that extends the weight not only to the sides, but also from the face to the back of the clubhead, while reference to base weighting, creating True Perimeter Weighting, otherwise known as Balanced Weighting, Split Weighting, Barbell Weighting, Seesaw Weighting, Elongated Toe Heel Weighting, or used up to an Eight Quadrant Weight Zones. The clubhead weight distribution can be at the extremities of the quadrants, away from, and balanced, in reference to the Bernie Point, with the clubhead designed accordingly.

When the Clubhead Face Orientation Plane is parallel to the clubhead face results in Weight Balanced Striking Power.

When the Clubhead Weight Distribution Axis is parallel to the clubhead face results in Balanced Weight Distribution.

Whereby, having the Clubhead Face Orientation Plane and the Clubhead Weight Distribution Axis back away from the face, in reference to the Swing Plane, and optimumly to the clubheads center Bernie Point results in Push Angle Reduction, or P.A.R., and the angular reduction of losses, with the ability of a clubhead miss hitting a ball to be more forgiving.

The Bernie Point is a variable located on the Center Of Mass Axis, and is used to determine any or all of the Six Sweet Spots.

The Bernie Point establishes all of the transferral of forces that are applied, in determining the resultant ball struck parameters.

To summarize this disclosure, when the Swing Plane is perpendicular to the Clubhead Face Orientation Plane, and perpendicular to Clubhead Weight Distribution Plane, all being perpendicular or parallel in relationship to the clubhead face, results in optimization of the Bernie Point Push Angle Reduction, and in relationship to the weight balancing of the Four Face Quadrants, and the True Sweet Spot or Two Sweet Spots face centering, whereby incorporating a Flat Base, when fitted to a golfer in his Stance Triangle, hence aligning to a ball and a target, produces the First Ultimate Golf Club design. The Second Ultimate Golf Club design is produced when the Clubhead Weight Distribution Plane is horizontal.

The Bernie Line and Bernie Point are the Deity in golf club design technology.

The invention relies on the Law of Physics that all Symmetrical and Nonsymmetrical instruments in their Dynamic Impact State have from one to an infinite number of Swing Planes and further that a symmetrical instrument Swing Plane has a Center Of Mass and Center Of Mass Axis, all within that instrument and further there is a perimeter line around each of these Swing Planes. Further the forward object striking portion of this perimeter impact line is called the Sweet Line that contains an Infinite Number of Sweet Spots or impact points with varying power levels.

A Nonsymmetrical instrument has a Swing Plane where the Center Of Mass Axis and Center Of Mass are within or may be external to that instruments mass, such as a golf club, which has a Swing Plane, and other planes and axes. The Swing Plane is subdivided and creates a perimeter line around the clubhead called the Bernie Line that encompasses the clubhead. The Bernie Line is subdivided into three major lines, Sweet Line, directional Target Line, and Training Line. The Sweet Line is Angular, varies between vertical and horizontal, and is the clubheads central striking axis. The Sweet Line contains a number of Infinite Sweet Spots with varying power levels, in which Six Sweet Spots are claimed, Ground Sweet Spot, Tee Sweet Spot, Maximum Sweet Spot, Optimum Sweet Spot, True Sweet Spot, and Minimum Sweet Spot. The Ground Sweet Spot and the Tee Sweet Spot are called the Two Sweet Spots that are referenced from the Maximum Sweet Spot to determine the lengths to hit a ball, called the Ground Hit Line and the Tee Hit Line. Above the Ground Sweet Spot and the Tee Sweet Spot we are unable to hit a ball, these lines are called the Ground Dead Line and the Tee Dead Line. These Two Sweet Spots can be identified to any number, but primarily to two ball heights on conventional clubs, or referenced to, and identified to any parameter change or changes. The Two Sweet Spots, are referenced to the two ball heights are the basis for determining the Ground Vertical Line and the Tee Vertical Line, and can be translated onto the top of the clubhead, respectively forming the Ground Target Line and Tee Target Line that are used to align the clubhead to the ball in the intended direction, whereby being in relationship to the Target Line and face contour.

The Ground Target Line and Tee Target Line connect to the Ground Training Line and the Tee Training Line, in relationship to the Training Line, that connects to the bottom of the Ground Vertical Line and the Tee Vertical Line, forming the Clubhead Ground Plane and Clubhead Tee Plane. As has been described the Ground Vertical Line and Tee Vertical Line are vertically displaced from each other requiring a later shift of the clubhead to coincide with that balls impact point height. In order to insure that the ball impact point height is constant when the ball is on a Tee a tool may be used. The true Sweet Spot can be used to identify a clubhead alignment to strike a ball at one specific height, requiring no lateral shifting of the clubhead. The Optimum Sweet Spot may or may not coincide with any of the Six Sweet Spots. The True Sweet Spot is designed to hit a ball at one height, but can facilitate a Second Base used to strike a ball at another height and have Automatic Loft. The True Sweet Spot can also be used to strike a ball at both heights, incorporating a clubhead having a Heel Base or Toe Base. The Sweet Line is controlled by the Three Triangles in golf, Stance Triangle, Club Triangle, and Alignment Triangle. The Sweet Line and derivatives exists on all clubs, that will change with parameter changes, but can be identified to each club and golfer's parameters. The present invention determines the location. The Sweet Line and derivatives will not change with a clubhead having a Flat Base that is fitted to a golfer's parameters, unless the clubhead is held incorrectly, or in another plane that becomes Automatically Hooded. The Hooding can facilitate a Hood Stop.

The Swing Plane has a Control Mass and an Orbital Mass. The Center Of Mass Axis can be moved back away from the clubhead face by shaft relocation called Centerset, or Optimum Centerset. If the Sweet Line was vertical, no lateral shifting of the clubhead would be required to strike a ball at any height. If the Sweet Line was more horizontal, more lateral shifting of the clubhead would be required to strike a ball at a different height. The Sweet Line can incorporate Horizontal Sweet Line Bulge, Vertical Sweet Line Roll, or Flat Sweet Line. The Sweet Line height can be referenced, to establish the top height of a clubhead. The Sweet Line height can be maximized on the clubhead called a Sweet Line Peak, or any derivatives. The Sweet Line deviation is also controlled by clubhead ground contact that is minimized by bottom face edge Plow. The Ground Target Line and Tee Target Line parallax and depth perception can be eliminated by incorporating an EyeAligner on the clubhead or ball. The Ground Target Line and Tee Target Line on conventional clubheads, can incorporate an Eyes Over The Ball focusing Antiparallaxer to eliminate parallax and depth perception.

The Swing Plane has several planes and axes that can be related to it. The Swing Plane contains several planes including Five Clubhead Planes, Clubhead Swing Plane, Clubhead Face Orientation Plane, Clubhead Weight Distribution Plane, Ground Sweet Spot Plane, and Tee Sweet Spot Plane. The Clubhead Weight Distribution Plane is formulated by a Quadrant Weight Distribution system, consisting of Eight Quadrant Weight Zones, with a Weight Distribution Face Line. These aforementioned planes contain several axes including Five Clubhead Axes, the Center Of Gravity Axis, Clubhead Weight Distribution Axis, True Sweet Spot Axis, Ground Sweet Spot Axis, and Tee Sweet Spot Axis. These planes and axes establish the Bernie Point, that when moved back away from the clubhead face results in Push Angle Reduction, otherwise known as P.A.R. The Bernie Point and all related planes and axes, relate to the Impact Swing Radius Arc and Impact Swing Radius Length. The Weight Distribution Face Line has two main Power Distribution Curves, the Sweet Line Power Curve, and the Weight Distribution Face Line Power Curve, in conjunction with Four Face Quadrants. The Sweet Line Angulation is primarily affected by Lower Toe Weighting, Extended Upper Toe Weighting and the Clubhead Weight Distribution Plane that when the Swing Plane Clubhead Face Orientation Plane and Clubhead Weight Distribution Plane are at right angles to each other, creates a Bernie Point. When the Swing Plane is perpendicular to the clubhead face, the result is an optimization of the Bernie Point and Push Angle Reduction. Henceforth incorporating Centerset and in relationship to the Quadrant Weight Distribution and the True Sweet Spot or Two Sweet Spots in consideration to face centering, whereby incorporating a Flat Base and fitting that golf club to a golfer in his Stance Triangle whereby aligning the correct Ground Vertical Line or the Tee Vertical Line in conjunction with a Target Line derivative to a ball, produces the First Ultimate Golf Club design.

All of the relationships to Clubhead Weight Distribution Plane when horizontal, results in the Second Ultimate Golf Club design. The Sweet Spot and its related Center Of Gravity terminology known throughout the centuries has been true but only applicable to a golf club Head without its components, and must be distinguished between New Technology, because it is not true and not applicable in use to a complete golf club, with all of its components, which requires New Terminology such as True Sweet Spot and Two Sweet Spots.

It is often asked what Sweet Spot means or refers to with regard to a club head. FIG. 14, illustrates one method for locating the conventional Sweet Spot 22 of a club head. The figure illustrates a club head without a shaft or grip or other components. The club head is shown with the club head face facing downward and balanced on a Sweet Line Locator 77.

The club head will only balance at one point. In the present invention I have gone beyond Sweet Spot to Sweet Line. My Sweet Line determines a broad range of ideal locations on the clubhead for impact with a golf ball to obtain maximum results and reduce adverse influences on control, accuracy, precision and distance. By having the ball struck at the correct impact point on the clubhead the ball will travel along it's intended path with the least amount of dispersion. The likelihood of the ball hooking or slicing is also reduced to a minimum. In the event the player actually desires the ball to hook or slice this may be accomplished by adjusting the clubhead position for impact, experience and practice would determine the exact adjustment to use.

The clubhead markings become a focused visual aid indicating exact clubhead positioning, when the golf club is swung. Most players take several preparatory swings prior to the swing that strikes the ball. The focused visual aid may be used in the preparatory swings using a blade of grass or other object in place of the ball. The focused visual aid is the Target Line which is also used as a training aid.

FIG. 15, illustrates a clubhead with Sweet Line 4 shown as a diagonal line, the Sweet Line 4 is raised to indicate both Angular Bulge 39' and Angular Roll 40'. Horizontal Bulge is the curvature of the clubhead face surface extending from the Toe to the Heel. Vertical Roll is the curvature of the clubhead face surface extending from the top Crown of the clubhead to the bottom Sole of the clubhead. Horizontal Bulge and Vertical Roll are typically related to the club head Sweet Spot. Angular Bulge is a curved and raised area on the golf clubhead face surface that follows the Sweet Line at the Sweet Line's diagonal. Angular Roll is a curved and raised area on the golf clubhead face surface that is perpendicular to the Sweet Line. My invention has the Angular Bulge and Angular Roll related to the Sweet Line. Angular Grooves 80 are shown parallel to the Sweet Line 4 and therefore at a diagonal. As an alternative the Angular Grooves could be perpendicular to the Sweet Line 4. It is also possible to have the Angular Grooves form a fan shaped design pointing upward with the fan shape center line being the Sweet Line 4 or downward with the fan shape center line being the Sweet Line 4 Also shown is Round Base 81. In addition Sweet Line Peak 34, also known as Hump, is shown together with Eyealigner 59, also known as Target Line.

FIG. 16, illustrates a conventional iron 67 shown in dotted lines and an iron with a curved base 81. Shown on the iron with curved base 81 is a Sweet Line Peak 34. Also shown is Sweet Line 4 as it would appear on both the conventional iron 67 and the iron with curved base 81.

FIG. 17, illustrates an iron with the Center Grip Shaft 42 aligned to point of contact for a ball resting on the ground at Ground Sweet Spot 10, which is the Sweet Line Centerset 48'. The Sweet Line Centerset is having the shaft and grip center line align with a specific point on the Sweet Line when the clubhead face surface is viewed form the toe of the clubhead. In FIG. 17 the specific point is the Ground Sweet Spot. The hosel can be positioned in order that the alignment takes place for any spot on the Sweet Line. The alignment forms a plane that includes the Shaft Center Line, the point selected on the Sweet Line and the horizontal line on the clubhead face surface that runs thru the point selected on the Sweet Line. Forward Press is when the Shaft Center Line is tilted off the vertical toward the intended direction of travel of the ball.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF DRAWINGS

In FIG. 17 the specific point is the Ground Sweet Spot.

DESCRIPTION OF THE PREFERRED EMBODIMENT

The detailed embodiments of the present invention are disclosed herein. It should be understood, however, that these embodiments are merely a model of the invention, which may be embodied in various forms, means, and use. The details disclosed herein are not to be interpreted as limited, but merely as the basis for the claims and derivatives thereof.

The past acknowledgment of a Golf Clubhead Sweet Spot is now transcended by revealing the existence of Two Sweet Spots on golf clubs that will be shown to have a Swing Plane with a Perimeter Line around each clubhead, called the Bernie Line, that is found during Dynamic Impact State Testing by recently developed scientific equipment by the inventor. From the Bernie Line we derive the following, an angled clubhead face Sweet Line containing one to a number of Infinite Sweet Spots impact points, with primarily Six Sweet Spots, consisting of Two Sweet Spots that are dominant in determining where to hit a ball from, either on the Ground or off the Tee, wherein are derived top and face identification directional Target Lines, offset to compensate for Parallax, or with an EyeAligner to align the eyes square to the clubhead and the ball, in the direction of intent, that necessitates a lateral shifting of the clubhead to that balls aforementioned, or any other height, wherein incorporating the means of locating a True Sweet Spot, on a clubhead used to hit a ball only at one height, with the advantage of a Second Base for two ball heights, and a Training Line. The Bernie Line, and its derivatives, will be the basis of invention, with associated aids in the partnership of the golf clubhead to the ball and target by using Three Triangles, relative to clubhead Soling, planes and axes, Push Angle Reduction, Sweet Line Horizontal Bulge and Vertical Roll, with a Hood feature.

Figure 2:
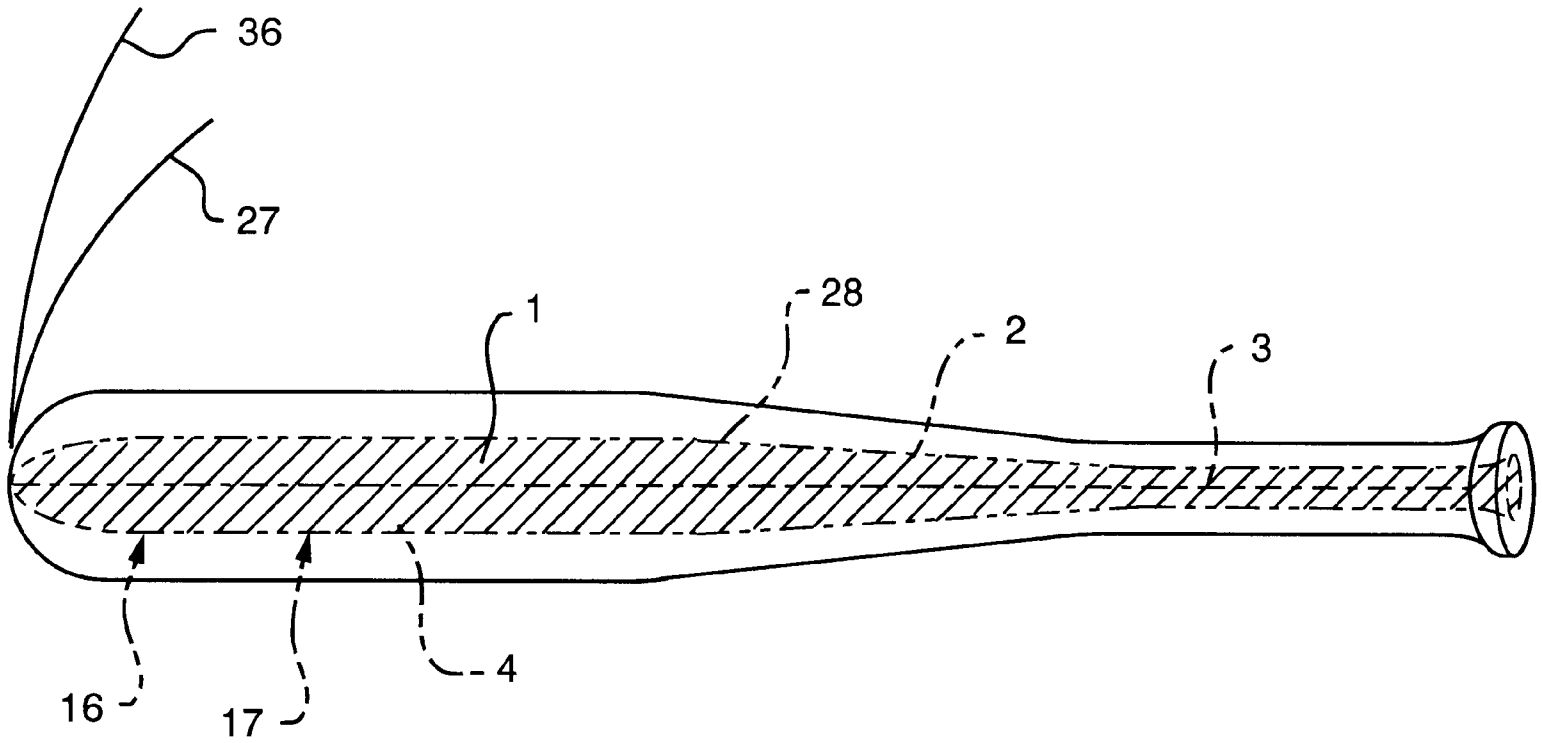
FIG. 2 is a perspective and interior view of a baseball bat with a swing plane and compositions. Shown are Optimum Sweet Spot 17, Swing Plane Arc 27 and Swing Plane Radius 36.

FIG. 2, illustrates a Symmetrical shape baseball bat in its Dynamic State, showing a Swing Plane 1, that represents one of an infinite number of identical cross sectional areas entirely within the instrument itself, if it is rotated.

When the bat is swung, and upon Dynamic Impact to a ball hit optimumly square at any location, results in a real Swing Plane 1, having a Perimeter Line 28, around that plane that is also called a Bernie Line 2, with a Center Of Mass Axis, C.O.M.A. 3, which is also interrelated with and known as the Center Of Gravity Axis, C.O.G.A. The forward or contact portion of the Bernie Line 2, is called the Sweet Line 4, which offers an infinite number of bat impact points, or Infinite Sweet Spots, that applies varying energy levels to the ball being struck, identifying a Maximum Sweet Spot 16, and an Optimum Sweet Spot 17.

The Maximum Sweet Spot 16, is a point on the end of the bat offering maximum power and control for the direction of intent, that may never be facilitated because of the ball diameter.

The Optimum Sweet Spot 17, is a point on the bat that takes into regards many parameters including Swing Plane 1, Swing Plane Arc 27, and Swing Plane Radius 36, that is dependant upon the object or ball diameter, compression, etc., wherein hitting the ball square, results in optimum power and control for the direction of intent.

Figure 1:
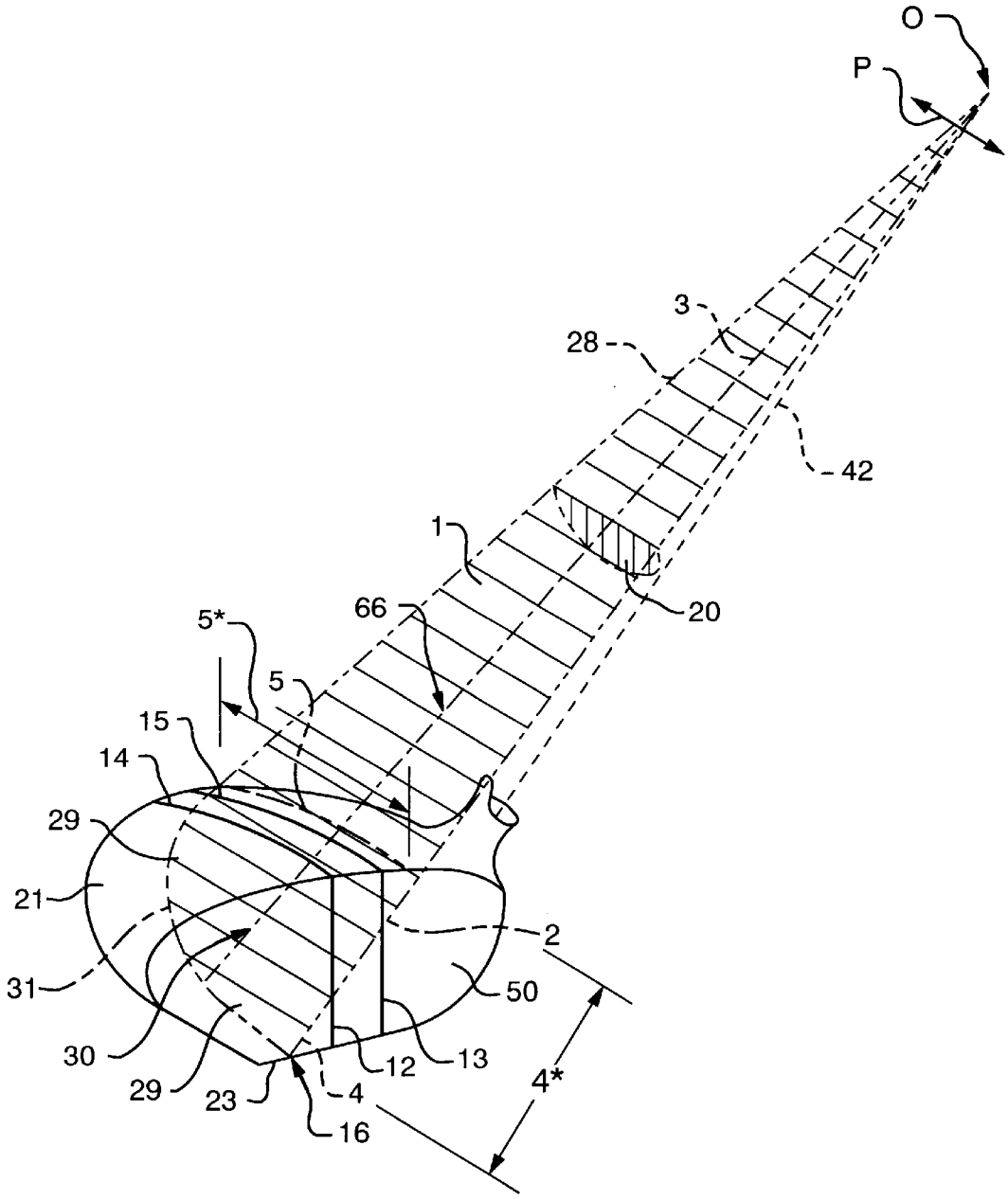
FIG. 1 is a perspective and interior view of a golf club wood, with a Shaft Grip Centerline 42, showing swing plane 1, club head swing plane 29, center of mass axis 3,, and alignment lines including: Bernie line 2; Sweet line 4, with 4* indicating the length; Target line 5, with 5* indicating the length; Ground Vertical line 12; Tee Vertical line 13; Ground Target line 14; Tee Target line 15; Perimeter line 28; and Training line 31. Also shown is Maximum Sweet Spot 16, Control Mass 20, Orbital Mass 21, Flat base 23, Bernie Point 30, Flat face 50 and Center of Mass 66.

FIG. 1, illustrates a nonsymmetrical shape clubhead with the shaft and grip being replaced by their center line Center Grip Shaft 42, as is also indicated on FIGS. 3, 4, 5, 7 and 8, that illustrates only the clubhead.

A golf club contains only one main Swing Plane 1, shown in slash lines, that does not stay within the instrument but extends from the grip top point O, going through free space, forming a Perimeter Line 28, encompassing the surface of the clubhead creating a subdivision on the clubhead called the Bernie Line 2, also shown in dash lines within and external to the face impact area, that encompasses a Clubhead Swing Plane 29, shown with double slash lines.

The Swing Plane 1, has a Center Of Mass Axis 3, and a Center of Mass 66, that is located in free space.

The Bernie Point 30, is the master design point, whereby the further back away from the face results in Push Angle Reduction or P.A.R.

The P represents the upper grip and shaft direction of forward or negative Press Deviation, in relationship to the hole, with the clubhead in one position aligned to an imaginary ball.

The Bernie Line 2, then subdivides into three basic interconnecting reference lines on the clubhead being identified as the Sweet Line 4, Target Line 5, on the top, and the Training Line 31, on all the other clubhead surfaces, rear and bottom.

The Sweet Line 4, is an angled line across the clubhead face that contains a number of Infinite Sweet Spots in which to hit a ball like the aforementioned baseball bat, that applies varying levels of power to the ball being struck. The length of this line is called the Sweet Line Length 4*. The Target Line 5, is a design reference that is used to interpolate the clubhead alignment to the ball in the Target Direction, at different locations on the clubhead Sweet Line 4, that will be dependant upon ball height that will be shown. Shown is Target Line Length 5* and Flat Face 50.

The Maximum Sweet Spot is shown as 16. Flat Base 23 is derived by a plane established by minimum points. Half of the subdivision of mass is called the Control Mass 20, with the other half mass called the Orbital Mass 21, on either side of the Swing Plane 1.

Figure 3:
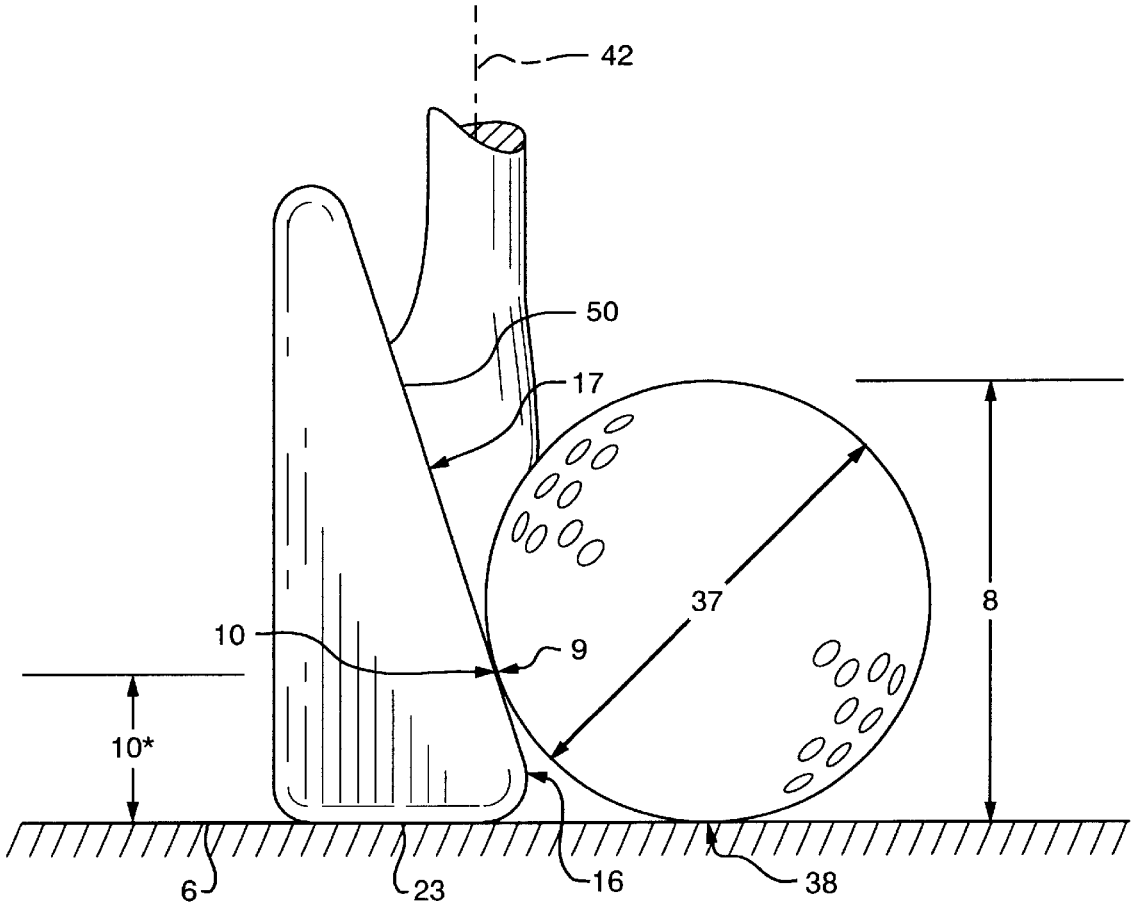
FIG. 3 is a side view of an iron clubhead to a ball on the ground, impact point relationship and Flat Base. Shown are Ground 6, Ball Ground Height 8, Ball Impact Point 9, Ground Sweet Spot 10, 10* being Ground Sweet Spot Height, Ball Diameter 37 and Ball Set Point 38.

FIG. 3, shows the Maximum Sweet Spot 16, and the varying Optimum Sweet Spot 17, having a Ball Diameter 37, with the Ball Height 8, measured from the ball resting on the Ground 6.

Figure 4:
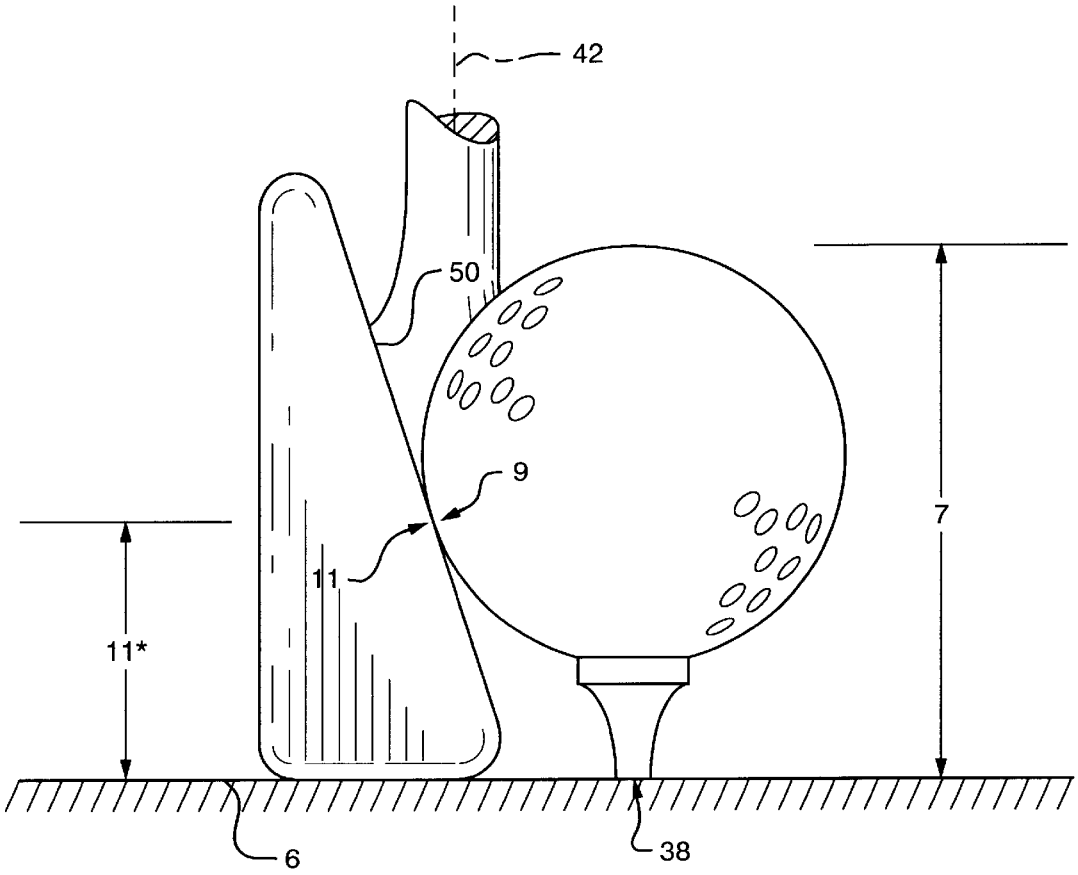
FIG. 4 is a side view of an iron clubhead to ball on a tee, impact point relationship. Shown are Ball Tee height 7, and Tee Sweet Spot 11, with 11* showing Tee Sweet Spot Height.

FIG. 4, shows the ball elevated on a Tee with Ball Tee Height 7, measured from the ball resting on the Ground 6.

Figure 6:
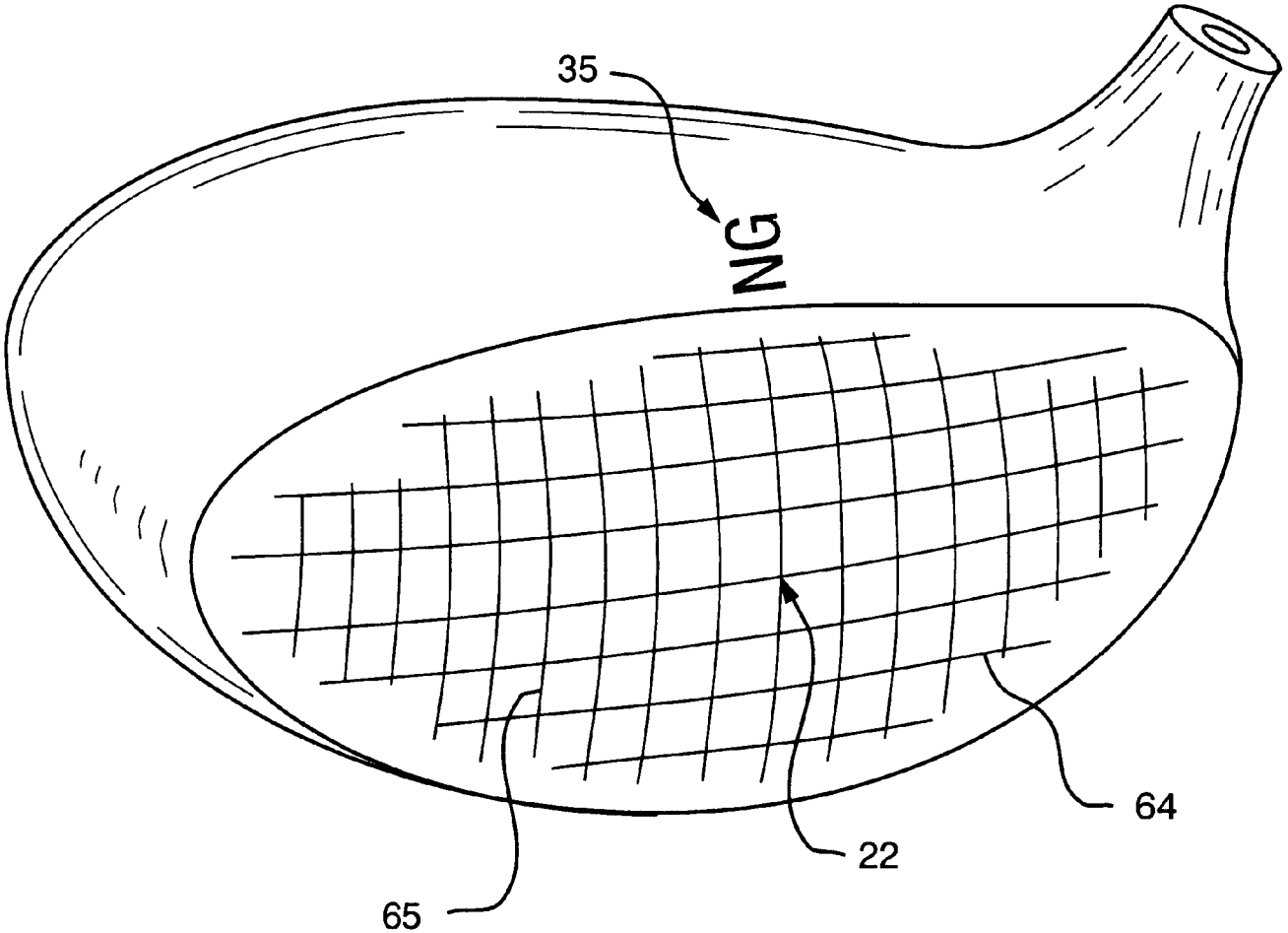
FIG. 6 is a perspective view of a conventional wood head. Shown are Sweet Spot 22, Sweet Spot Alignment Spot 35, Horizontal Face Bulge 64 and Face Bulge 65.

FIGS. 3 and 4, illustrates a typical clubhead shown is a Flat Face iron 50, that is aligned to a ball, in relationship to two different ball heights that will strike a ball at the same Ball Impact Point 9, which is not true for curved face clubheads as shown in FIG. 6, with Horizontal Face Bulge 64, and Vertical Face Roll 65.

These figures also illustrate that a ball's height can be changed from the Ground to on a Tee, at one specific location point called the Ball Set Point 38. Thusly, when comparing these figures to the clubheads alignment to the Ball Impact Point 9, with face impact points FIG. 3 Ground Sweet Spot 10 and FIG. 4 Tee Sweet Spot 11, illustrating that these clubhead impact points change accordance with ball height. The heights of these face impact points are measured from Ground 6, and in FIG. 3 called the Ground Sweet Spot Height 10*, and in FIG. 4 called the Tee Sweet Spot Height 11*, with both heights then being transferred to FIG. 5.

Figure 5:
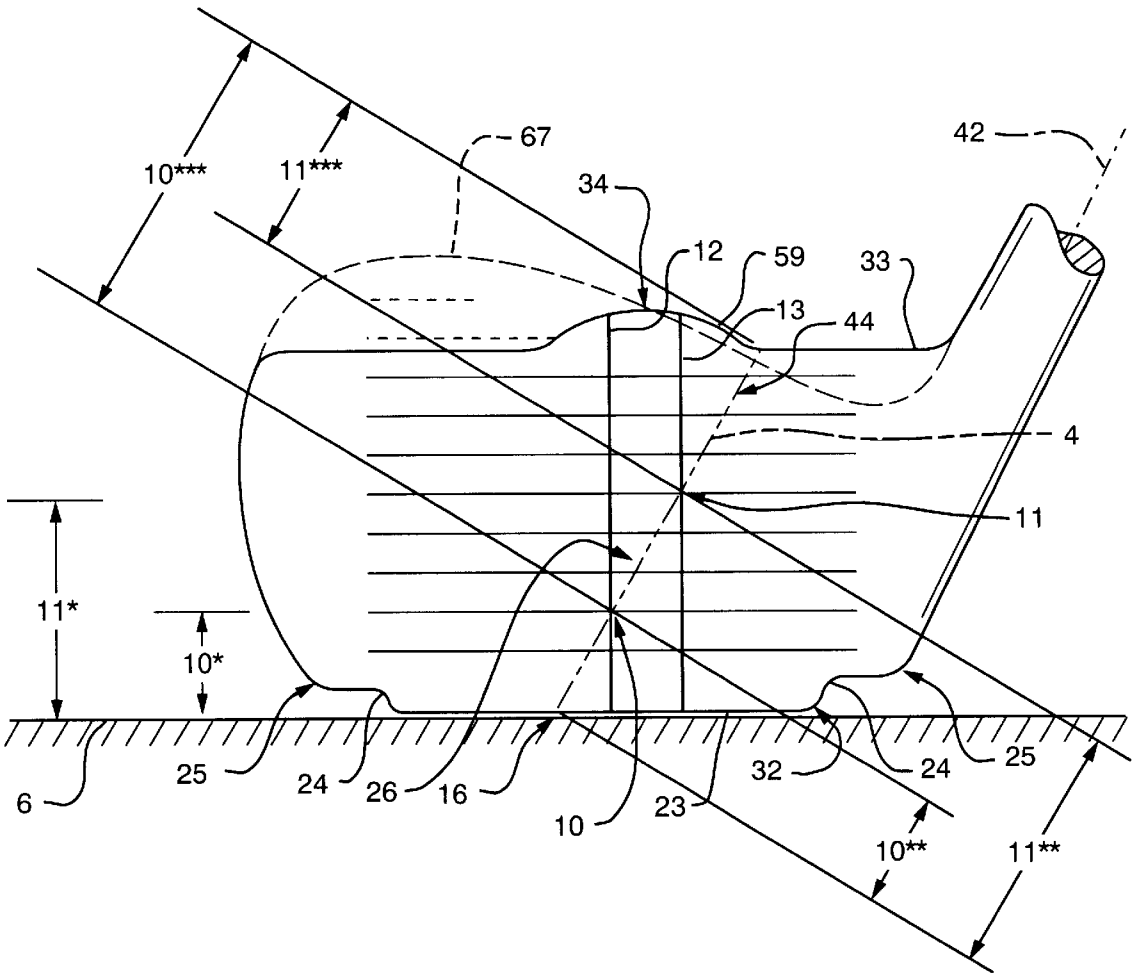
FIG. 5 is a front view of an iron embodying the present invention. Shown are 10 indicates Ground Hit Line, 10*** indicates Ground Dead Line, 11** indicates Tee Hit Line, 11*** indicates Tee Dead Line, Hood 24, Hood Stop 25, True Sweet Spot 26, Hood Point 32, Sweet Line Height 33, Sweet Line Peak 34, Eyealigner 59, and Conventional Iron 67**.

FIG. 5, shows the Ground Sweet Spot Height 10*, and Tee Sweet Spot Height 11*, that are now represented as horizontal lines intersecting the Sweet Line 4, respectively at Ground Sweet Spot 10, and Tee Sweet Spot 11, that clearly illustrates and proves that a change in ball height at one location, re. FIGS. 3 and 4 Ball Set Point 38 on the Ground 6, requires a lateral shifting of the clubhead for it to strike a ball on the angled Sweet Line 4, thusly establishing Two Sweet Spots, whereby bidding Adios to one sweet spot.

Vertical lines are then identified on the clubhead face impact area intersecting with the Ground Sweet Spot 10 and the Tee Sweet Spot 11, respectively being called the Ground Vertical Line 12 and Tee Vertical Line 13, that can then be extended external to the face impact area on this Iron, or any clubhead as shown in FIG. 1.

FIG. 1, Ground Vertical Line 12, and Tee Vertical Line 13, are shown on a Wood, that are now translated to the top of the clubhead and identified respectively as, the Ground Target Line 14 and the Tee Target Line 15, that results in the correct orientation of the clubhead to a ball, at either height, toward the direction of intent. These Target Lines are applicable to all golf clubs.

FIG. 5, shows a conventional Iron 67, with the striking face area concentrated at the toe of the clubhead, Minimum Sweet Spot 44. The Ground Hit Line length 10, and the Tee Hit Line length 11**, is the only available striking length where the ball normally can be struck, on the Sweet Line 4, whereas above the Ground Sweet Spot 10 and the Tee Sweet Spot 11, are respectively called the no hit lines or Ground Dead Line 10***, and the Tee Dead Line 11***, that can not be facilitated unless the clubhead makes contact with the ground first, or the ball is on an incline height which alters the lateral shifting of the clubhead. A ball can be struck below points 10 and 11 by elevation of the clubhead or if the ball is embedded, which also requires a lateral shifting to maintain impact on the Sweet Line 4. FIG. 5 validates maximized clubhead height in relationship to the Sweet Line 4. FIG. 5 also shows the Maximum Sweet Spot 16, and the True Sweet Spot 26, also called the Huzza Point, shown between the Ground Sweet Spot 10 and the Tee Sweet Spot 11**.

Clubheads designed with a Low or Shallow Height using only one specific height parameter from where a ball is to be hit from, for example on the ground, need not necessarily facilitate Ground Sweet Spot 10 or Tee Sweet Spot 11 terminology, that can be more accurately renamed by using the factual Sweet Line principle of determination and called the True Sweet Spot 26.

The Tee Sweet Spot 11, distance to the Maximum Sweet Spot 16, offers more available Sweet Line to hit the ball compared to the Ground Sweet Spot 10.

Shown is a clubhead with Flat Base 23, so as when the lie angle is decreased to beyond Hood Point 32 at the heel, the clubhead will Hood or Automatically Hood 24, wherein incorporating a limit called Hood Stop 25, with the converse being applicable to the toe with an increasing lie angle. This Hooding alerts the golfer that his Two Sweet Spots references have shifted and requires remedial action.

Also shown is the Sweet Line Height 33, as being the maximum or reference height of the club, oppose to having the maximum height at the toe where the ball is not intentionally hit. The Ground Vertical Line 12, and the Tee Vertical Line 13, can also be applied to clubhead height, such as with the Two Sweet Spots Peak or Sweet Line Peak 34, offering increased clubhead face striking area where the ball should be hit, being applicable to Shallow Height clubs and called the True Sweet Spot Peak.

The EyeAligner 59 is a backup mechanism to the Base that alerts the golfers that something is out of position, including the way that he's holding the club.

Figure 10:
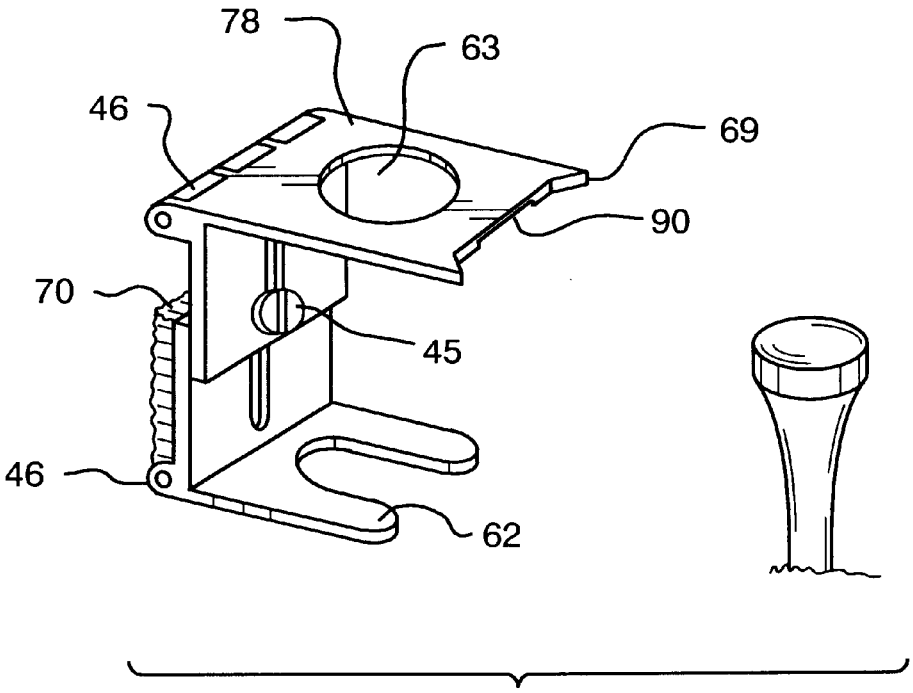
FIG. 10 shows a perspective view of the RighTee-HeighTee tool 78, indicating Adjustable Tee Height 45, Hinged Foldup 46, Ball Mark Repair Tool 62, Ball Marker 63, Groove Cleaner 69, Clubhead Face Cleaning Pad 70 and Tee Head Retainer 90.

FIG. 5, shows Ground Sweet Spot 10, that is a constant, whereas the Tee Sweet Spot 11, is a variable caused by golfers inconsistency of Tee height during its installation, that results in Tee Target Line error. To establish a constant Tee Sweet Spot 11, the tee must be installed into the ground at the same height each time. To accomplish this, FIG. 10 shows a RighTEE-HeighTEE tool 78, with Adjustable Tee Height 45, that can be facilitated to each golfers Tee ball height in direct correlation to the Tee Sweet Spot 11. This versatile RighTEE-HeighTEE tool incorporates a Hinged Foldup 46, for compactness, with the bottom used as a Ball Mark Repair Tool 62, a Ball Marker 63, Groove Cleaner 69, Clubhead Face Cleaning Pad 70, and a Tee Head Retainer 90 to prevent Tee slippage during installation. The tool can be modified to incorporate a Tee with a Ball combination.

FIG. 6, shows past conventional Wood Head, without its grip and shaft components, that this patent does acknowledge as having a Sweet Spot 22, a Sweet Spot Alignment Mark 35, that is normally a point indicator, line, name or no markings at all, with Horizontal Face Bulge 64 and Vertical Face Roll 65, constructed around this Sweet Spot 22, or in conjunction with the Head center of gravity. Alas, designing a clubhead without its components has been golf Tunnel Vision and nemesis for centuries, until now.

Figure 7:
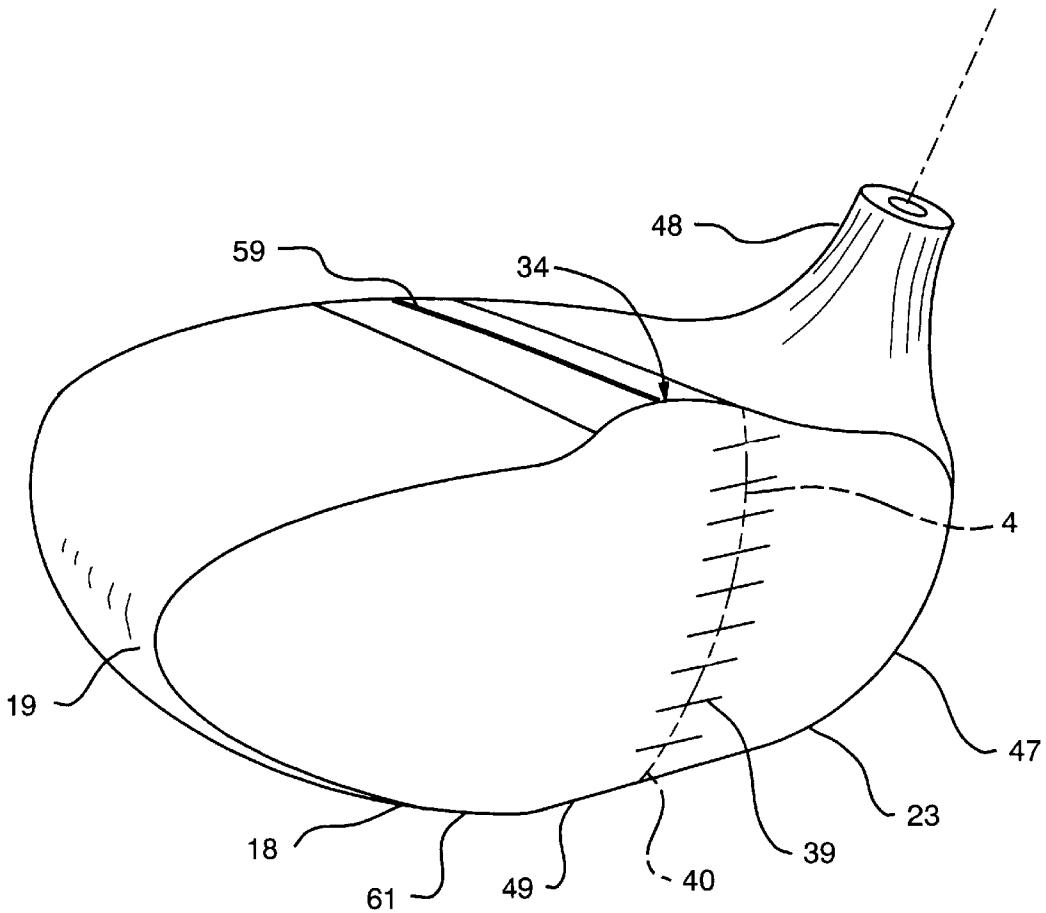
FIG. 7 is a perspective view of a novel wood clubhead. Shown are Lower Toe Weight 18, Upper Toe Weight 19, Sweet Line Horizontal Face Bulge 39, Sweet Line Face Vertical Roll 40, Heel Base 47, Centerset 48, Plow 49 and Toe Base 61.

FIG. 7, shows a slightly modified conventional clubhead with Flat Base 23, Heel Base 47, and Toe Base 61, incorporated in conjunction to controlling vertical or horizontal positioning of the Sweet Line. Also shown is the convexness of Sweet Line Horizontal Face Bulge 39, and Sweet Line Face Vertical Roll 40, incorporated into Sweet Line 4. Shown is Lower Toe Weighting 18, and Upper Toe Weighting 19, Sweet Line Peak 34, CenterSet 48, Plow 49, and EyeAligner 59.

Figure 8:
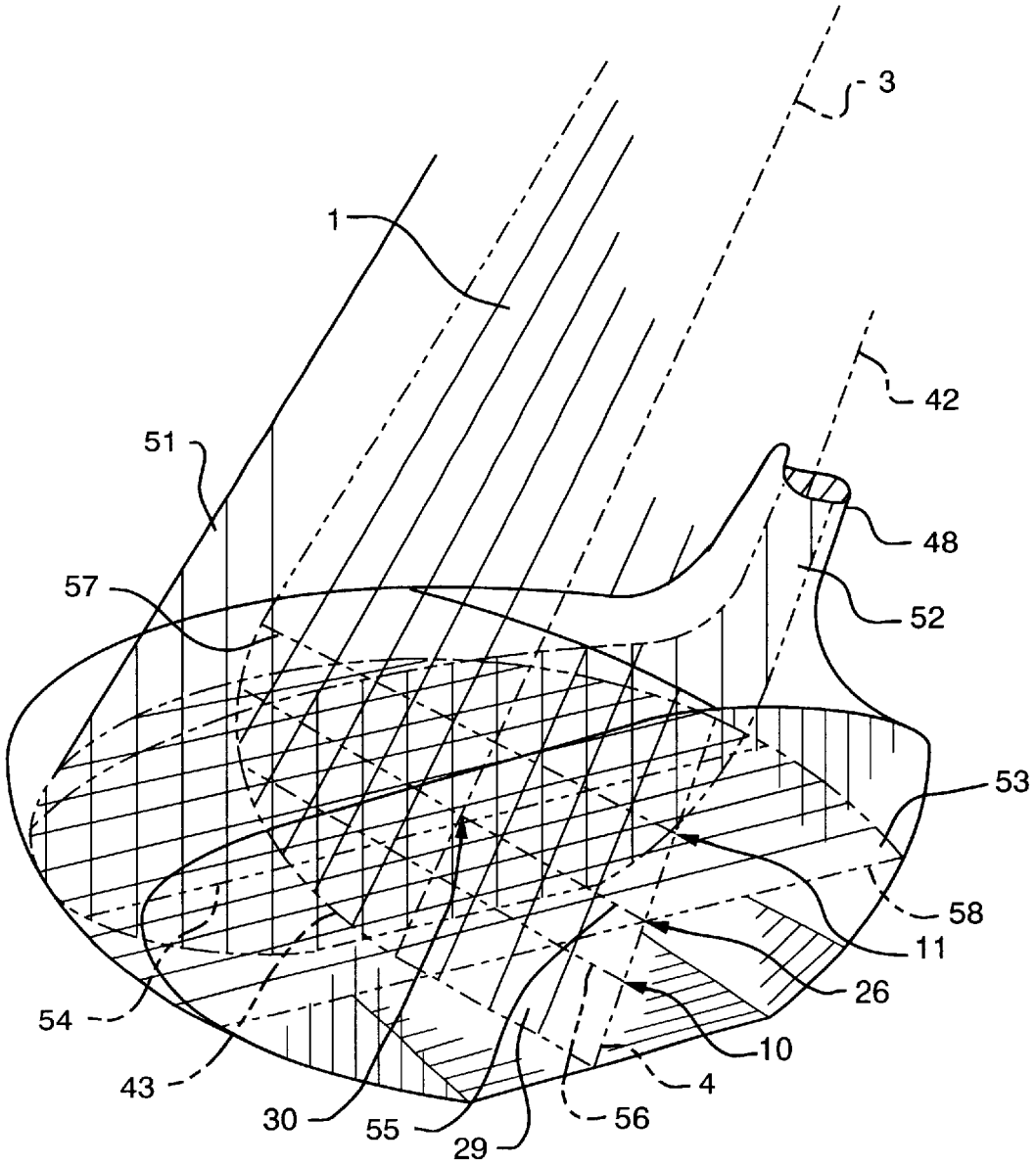
FIG. 8 is a perspective and interior view of a partially embodied wood clubhead with planes and axes correlation to a Weight Distribution Face line parallel to a Flat Base. Shown are Second Base 43, Face Orientation Plane 51, Clubhead Face Orientation Plane 52, Weight Distribution Plane 53, Weight Distribution Axis 54, True Sweet Spot Axis 55, Ground Sweet Spot Axis 56, Tee Sweet Spot Axis 57 and Weight Distribution Face Line 58.
Figure 9:
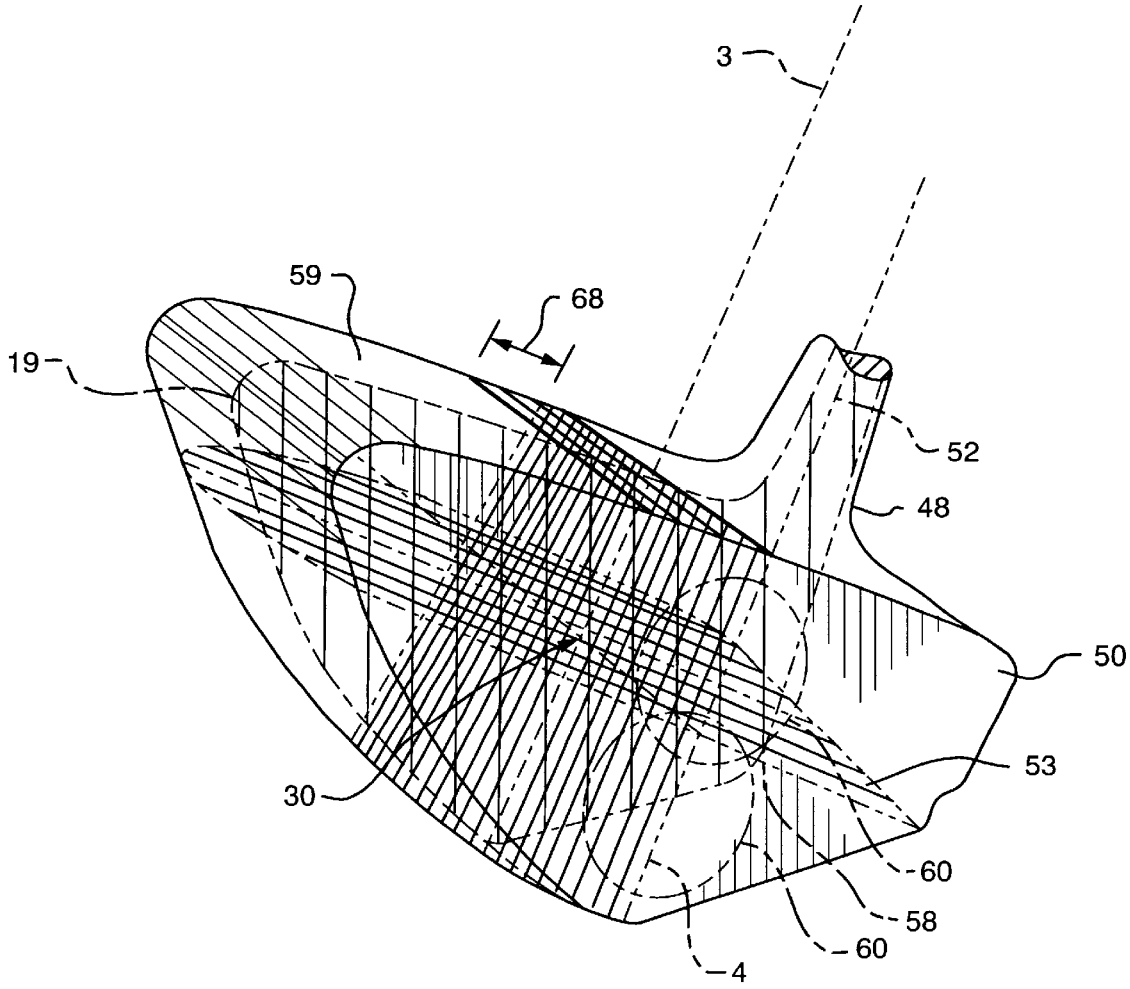
FIG. 9 is a perspective and interior view of a partially embodied wood clubhead with an EyeAligner, perpendicular planes and axes correlation. Shown is Maximum Ball Compression Area 60.

FIGS. 8 and 9 illustrates that there are several planes and axes that relates directly to this disclosures Two Sweet Spot technology, with interaction phenomena showing the versatility of concept.

FIG. 8, shows another slightly modified conventional clubhead incorporating, Sweet Line 4, Ground Sweet Spot 10, Tee Sweet Spot 11, and True Sweet Spot 26. Also shown is Second Base 43, for automatic loft and ball height control that can be in relationship with EyeAligner 59 as shown on FIG. 9.

FIG. 8 shows Swing Plane 1, and Face Orientation Plane 51. Also shows the Five Clubhead Axes, Center Of Gravity Axis 3, True Sweet Spot Axis 55, Ground Sweet Spot Axis 56, Tee Sweet Spot Axis 57, and Clubhead Weight Distribution Axis 54.

The intersection of three planes, Clubhead Swing Plane, Clubhead Face Orientation Plane, Clubhead Weight Distribution Plane, or related axes, is called the Bernie Point 30.

FIG. 8 shows three of the Five Clubhead Planes, Clubhead Swing Plane 29, Clubhead Face Orientation Plane 52, and Clubhead Weight Distribution Plane 53, with a Clubhead Weight Distribution Face Line 58 shown parallel and horizontal to the Flat Base for ball impact regulation when at one height along this line, affording a more horizontal Sweet Line for increased lateral movement between Two Sweet Spots, and alternate base weighting considerations, while incorporating CenterSet to move the Bernie Point 30 back to optimize Push Angle Reduction.

FIG. 9 shows EyeAligner 59, having the top of the clubhead in line with the golfers eyes for target alignment that eliminates parallax and depth perception, resulting in optimum viewing of the target lines, and its range limits called Target Line Range Limits 68, reference to the Sweet Line 4.

Shows Maximum Ball Compression Areas 60, equidistant upon the Sweet Line axis subdivided by the Clubhead Weight Distribution Plane 53, with overlapping characteristics for balanced quadrant weighting in reference to two ball heights.

The Clubhead comprises the Weight Distribution Face Line 58, and Clubhead Weight Distribution Plane 53, that is perpendicular to the Sweet Line 4, and angled from horizontal because of Upper Toe Weighting 19, that results in the alignment the Clubhead Face Orientation Plane parallel to the Flat Face 50 while centered in the clubhead due to CenterSet 48, with the Center Of Mass Axis 3, whereby all planes and axes are ninety degrees in relationship to each other, intersecting at the Bernie Point 30, produces balanced quadrant weighting and ultimate ball control for hitting it at alternate heights.

Their are four basic methods of locating the Bernie Lines Sweet Line and its derivatives, the Dynamic Clubhead Impacting To The Golf Ball Method, Dynamic Golf Ball Impacting To The Clubhead Method, Static Clubhead Loft Angle Plumb Bobbing Method, and the Static Horizontal Clubhead Face Balancing Method.

Figure 11:
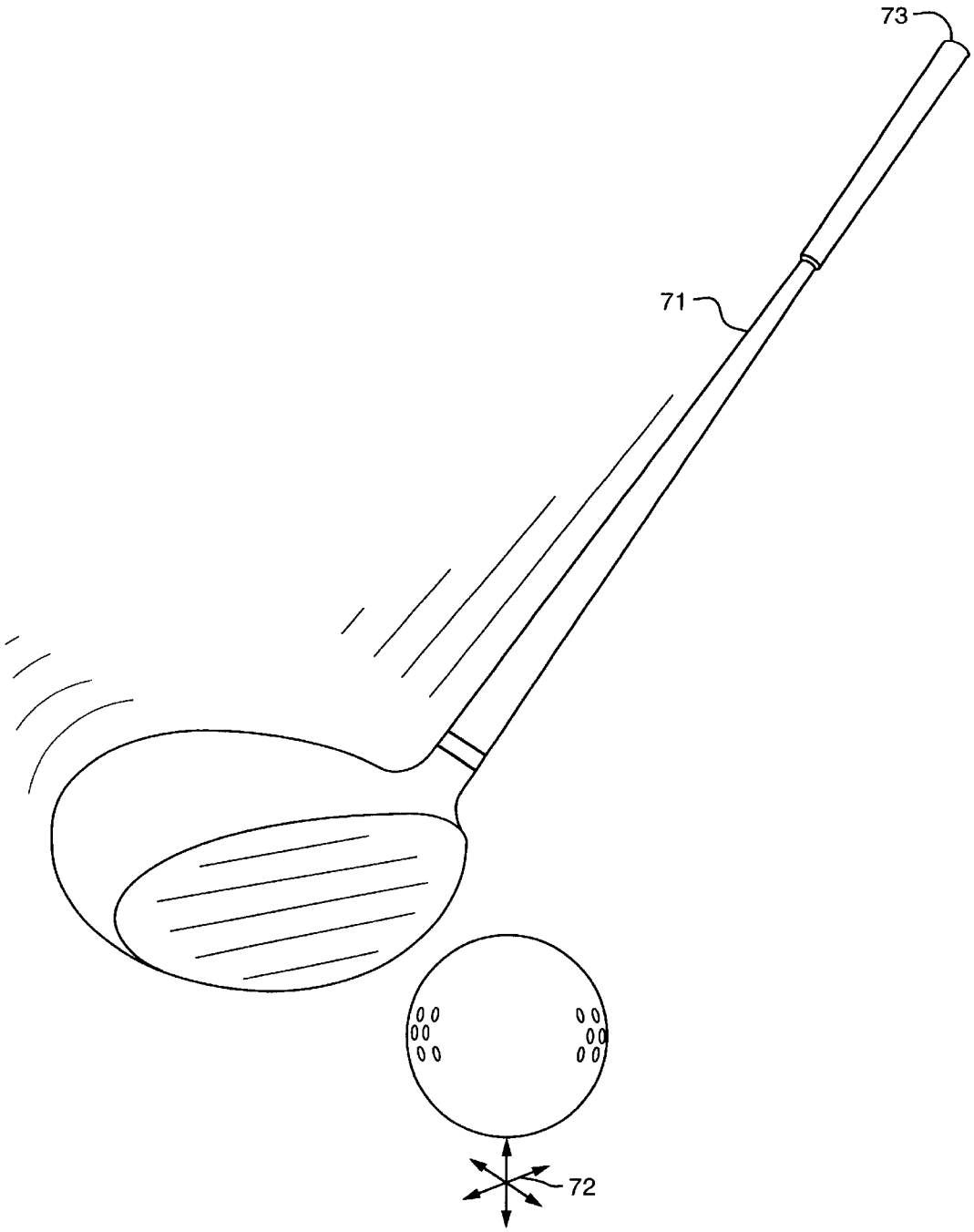
FIG. 11, illustrates the Dynamic Clubhead Impacting To The Golf Ball Method. Shown are A Golf Club 71, Spherical Quadrant Shifter 72 and a Club Torque Responder 73.

FIG. 11, shows the Dynamic Clubhead Impacting To The Golf Ball Method, that is accomplished by Swinging A Golf Club 71, to strike a series of stationary balls at different positions and heights whose location is controlled by a Spherical Quadrant Shifter 72, that can also be adapted to the club, with the club incorporating a Club Torque Responder 73, to measure Sweet Line off or on hits, with related derivatives and data that can be extracted for graphic and statistical analysis for clubhead design. This method can be reversed, by the striking a stationary clubhead with a moving ball called the Dynamic Golf Ball Impacting To The Clubhead Method.

Figure 12:
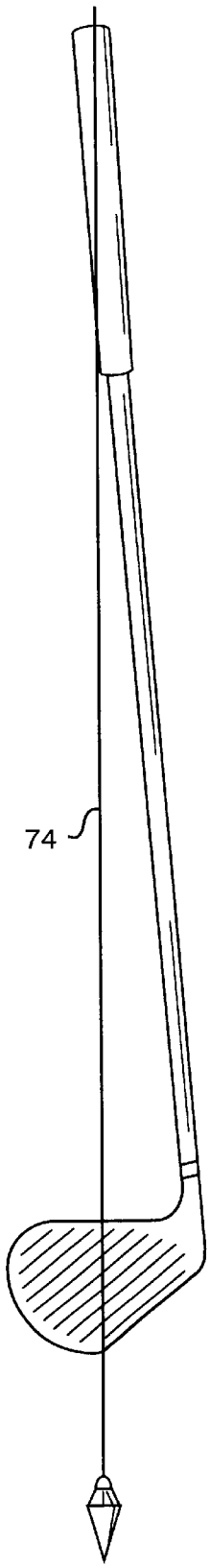
FIG. 12, illustrates the Static Clubhead Loft Angle Plumb Bobbing Method. Shown is Plumb Bob 74.

FIG. 12, shows the Static Clubhead Loft Angle Plumb Bobbing Method, that is accomplished by suspending the golf club vertically from the center top of the grip and suspending a Plumb Bob 74, that will not result in the correct Sweet Line, unless the clubhead face loft angle, Horizontal Face Bulge and Vertical Face Roll are taken into consideration.

Figure 13:
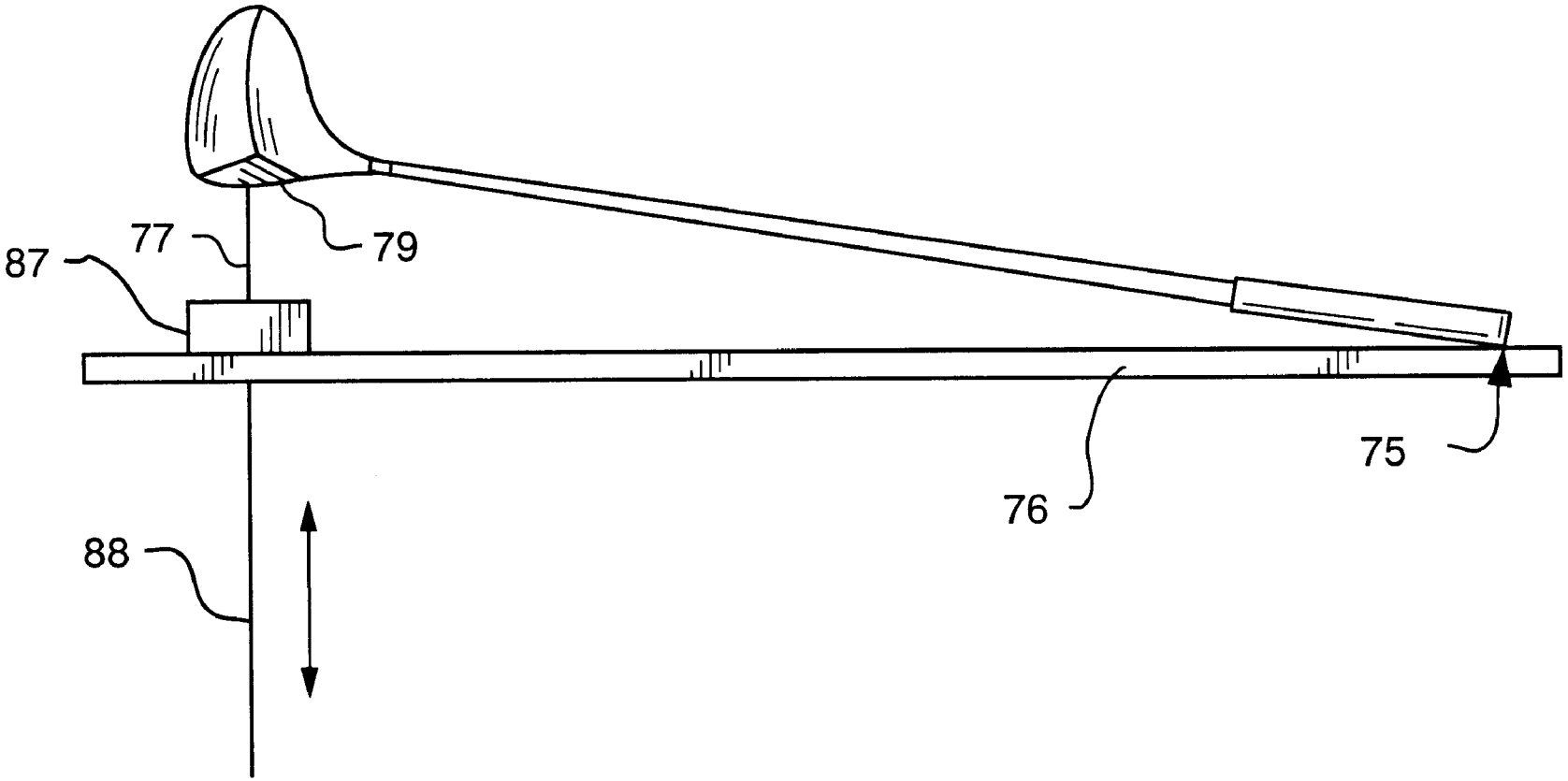
FIG. 13, illustrates, the Static Horizontal Clubhead Face Balancing Method. Shown are the Club Grip End 75, a Level Platform 76, the Clubhead Face 79 and the Sweet Line Locator Tool 77. Also shown are Donut Shaped Stabilizer Base Member 87 and Rigid Rod 88.

FIG. 13, shows the Static Horizontal Clubhead Face Balancing Method, that is accomplished by having the Club Grip End 75, resting on a Level Platform 76, with the Clubhead Face 79, resting on a Sweet Line Locator Tool 77, with the tool having an adjustable height vertical gauge, Rigid Rod 88, whose top can be pointed, horizontally flat or contoured to match the Clubhead Face 79, wherein contacts the horizontal face at balance points simulating where a ball should be hit, or otherwise. Also shown is Donut Shaped Stabilizer Base Member 87.

Once the Sweet Line is derived by any of the aforementioned methods, the Target Lines can be determined geometrically, or by a precipitous relationship, to any ball impact point.

Figure 14:
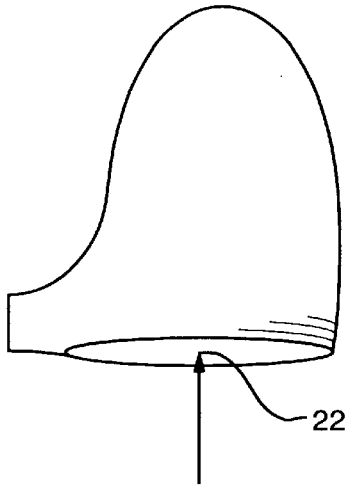
FIG. 14, illustrates one method for locating the conventional Sweet Spot 22 of a club head. The figure illustrates a club head without a shaft or grip or other components. The club head is shown with the club head face facing downward and balanced on a Sweet Line Locator 77. The club head will only balance at one point.

It is often asked what Sweet Spot means or refers to with regard to a club head. FIG. 14, illustrates one method for locating the conventional Sweet Spot 22 of a club head. The figure illustrates a club head without a shaft or grip or other components. The club head is shown with the club head face facing downward and balanced on a Sweet Line Locator 77. The club head will only balance at one point. In the present invention I have gone beyond Sweet Spot to Sweet Line. My Sweet Line determines a broad range of ideal locations on the clubhead for impact with a golf ball to obtain maximum results and reduce adverse influences on control, accuracy, precision and distance. By having the ball struck at the correct impact point on the clubhead the ball will travel along it's intended path with the least amount of dispersion. The likelihood of the ball hooking or slicing is also reduced to a minimum. In the event the player actually desires the ball to hook or slice this may be accomplished by adjusting the clubhead position for impact, experience and practice would determine the exact adjustment to use.

The clubhead markings become a focused visual aid indicating exact clubhead positioning, when the golf club is swung. Most players take several preparatory swings prior to the swing that strikes the ball. The focused visual aid may be used in the preparatory swings using a blade of grass or other object in place of the ball. The focused visual aid is the Target Line which is also used as a training aid.

Figure 15:
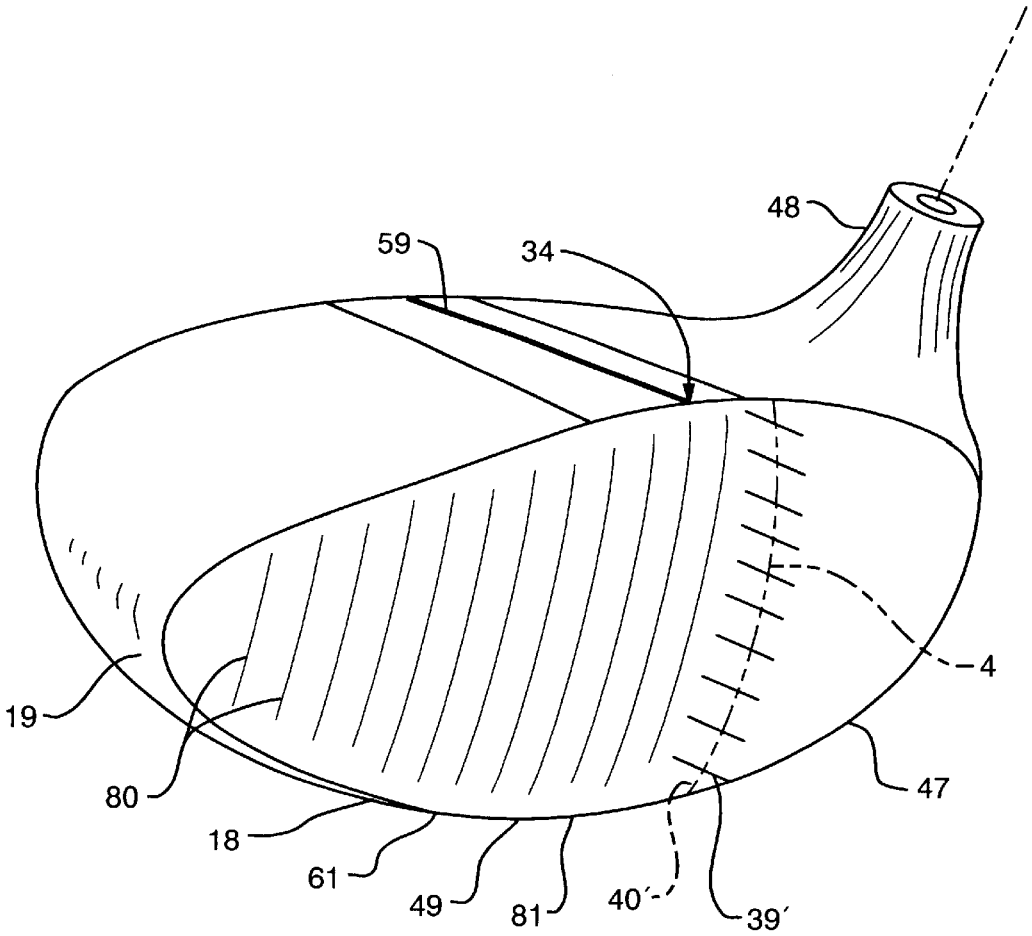
FIG. 15, illustrates a clubhead with Sweet Line 4 shown as a diagonal line, the Sweet Line 4 is raised to indicate both angular bulge 39' and angular roll 40'. Angular Grooves 80 are shown parallel to the Sweet Line 4 and therefore at a diagonal. Also shown is Round Base 81. In addition Sweet Line Peak 34, also known as Hump, is shown together with Eyealigner 59, also known as Target Line.

FIG. 15, illustrates a clubhead with Sweet Line 4 shown as a diagonal line, the Sweet Line 4 is raised to indicate both Angular Bulge 39' and Angular Roll 40'. Horizontal Bulge is the curvature of the clubhead face surface extending from the Toe to the Heel. Vertical Roll is the curvature of the clubhead face surface extending from the top Crown of the clubhead to the bottom Sole of the clubhead. Horizontal Bulge and Vertical Roll are typically related to the club head Sweet Spot. Angular Bulge is a curved and raised area on the golf clubhead face surface that follows the Sweet Line at the Sweet Line's diagonal. Angular Roll is a curved and raised area on the golf clubhead face surface that is perpendicular to the Sweet Line. My invention has the Angular Bulge and Angular Roll related to the Sweet Line. Angular Grooves 80 are shown parallel to the Sweet Line 4 and therefore at a diagonal. As an alternative the Angular Grooves could be perpendicular to the Sweet Line 4. It is also possible to have the Angular Grooves form a fan shaped design pointing upward with the fan shape center line being the Sweet Line 4 or downward with the fan shape center line being the Sweet Line 4 Also shown is Round Base 81. In addition Sweet Line Peak 34, also known as Hump, is shown together with Eyealigner 59, also known as Target Line.

Figure 16:
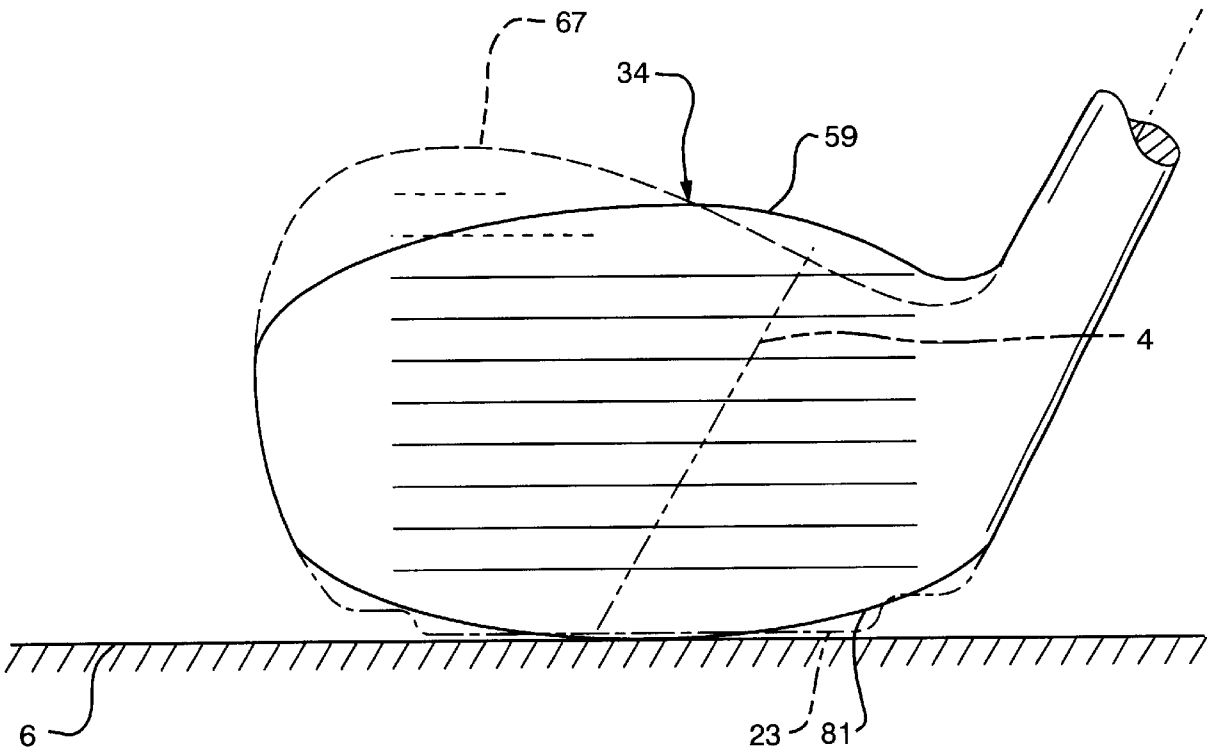
FIG. 16, illustrates a conventional iron 67 shown in dotted lines and an iron with a curved base 81. Shown on the iron with curved base 81 is a Sweet Line Peak 34. Also shown is Sweet Line 4 as it would appear on both the conventional iron 67 and the iron with curved base 81.

FIG. 16, illustrates a conventional iron 67 shown in dotted lines and an iron with a curved base 81. Shown on the iron with curved base 81 is a Sweet Line Peak 34. Also shown is Sweet Line 4 as it would appear on both the conventional iron 67 and the iron with curved base 81.

Figure 17:
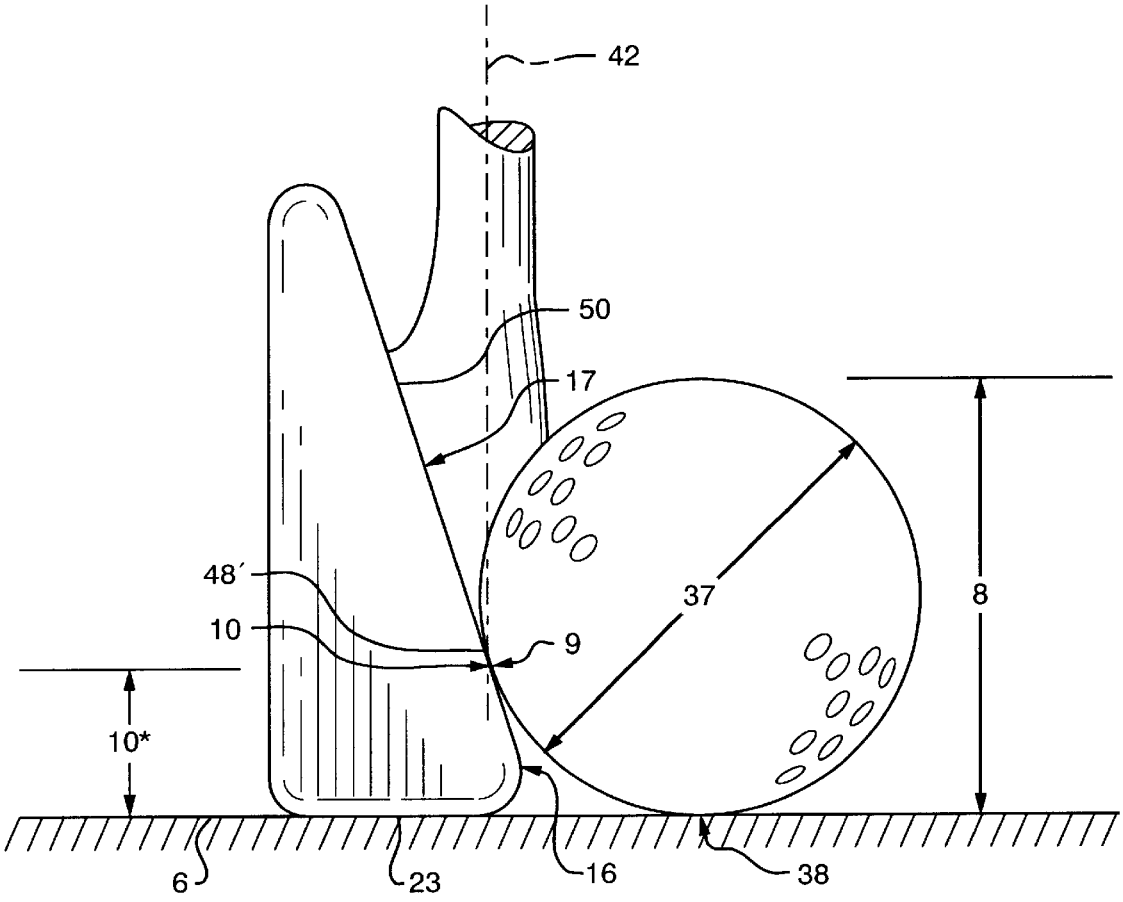
FIG. 17, illustrates an iron with the Center Grip Shaft 42 aligned to point of contact for a ball resting on the ground at Ground Sweet Spot 10, which is the Sweet Line Centerset 48'. The Sweet Line Centerset is having the shaft and grip center line align with a specific point on the Sweet Line when the clubhead face surface is viewed from the toe of the clubhead.

FIG. 17, illustrates an iron with the Center Grip Shaft 42 aligned to point of contact for a ball resting on the ground at Ground Sweet Spot 10, which is the Sweet Line Centerset 48'. The Sweet Line Centerset is having the shaft and grip center line align with a specific point on the Sweet Line when the clubhead face surface is viewed form the toe of the clubhead. In FIG. 17 the specific point is the Ground Sweet Spot. The hosel can be positioned in order that the alignment takes place for any spot on the Sweet Line. The alignment forms a plane that includes the Shaft Center Line, the point selected on the Sweet Line and the horizontal line on the clubhead face surface that runs thru the point selected on the Sweet Line. Forward Press is when the Shaft Center Line is tilted off the vertical toward the intended direction of travel of the ball.

Figure 18:
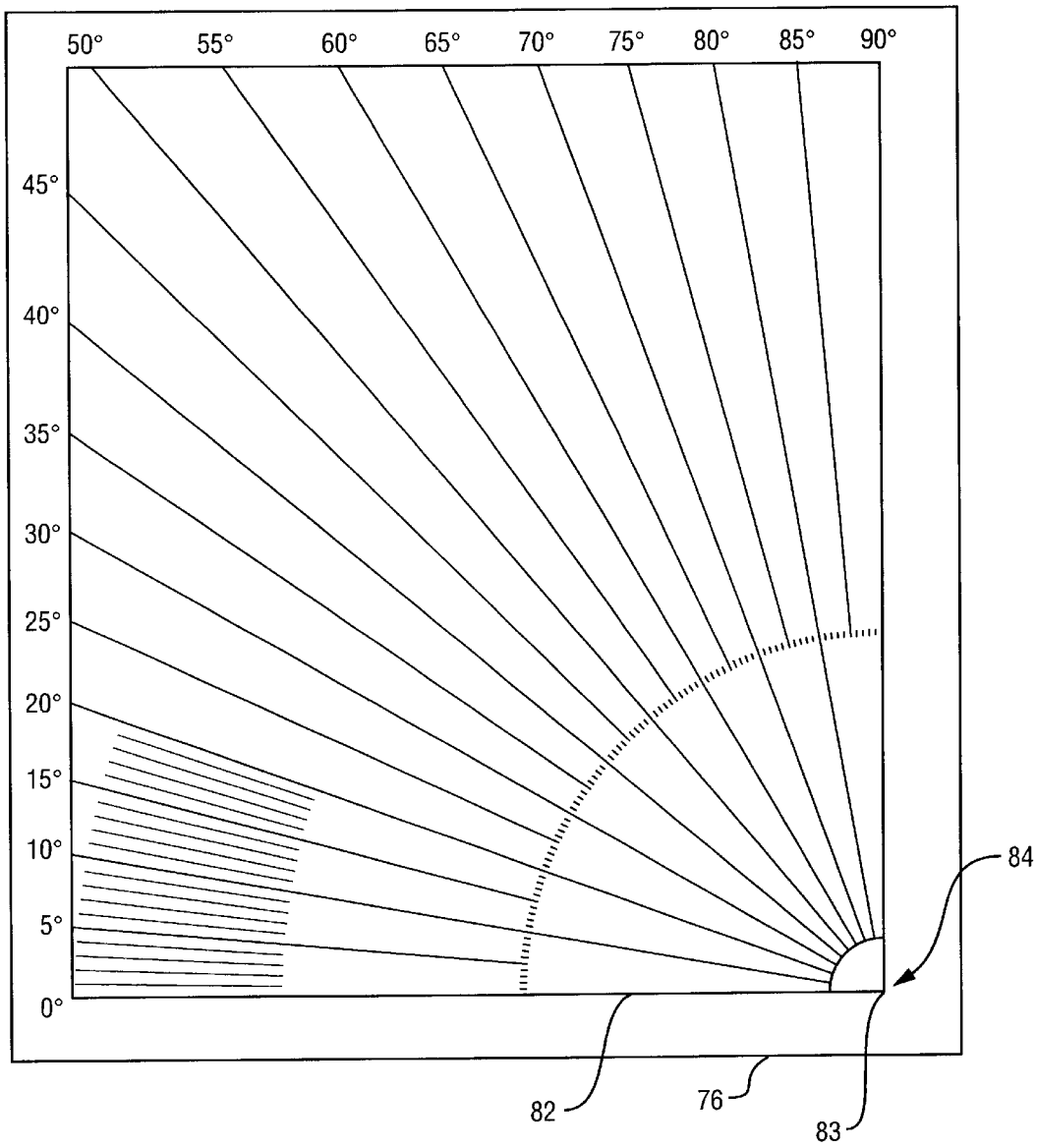
FIG. 18 shows the Lie Angle Paper 82, Lie Angle Base Corner 83, Level Platform 76 and Hole In Level Platform 84.
Figure 19:
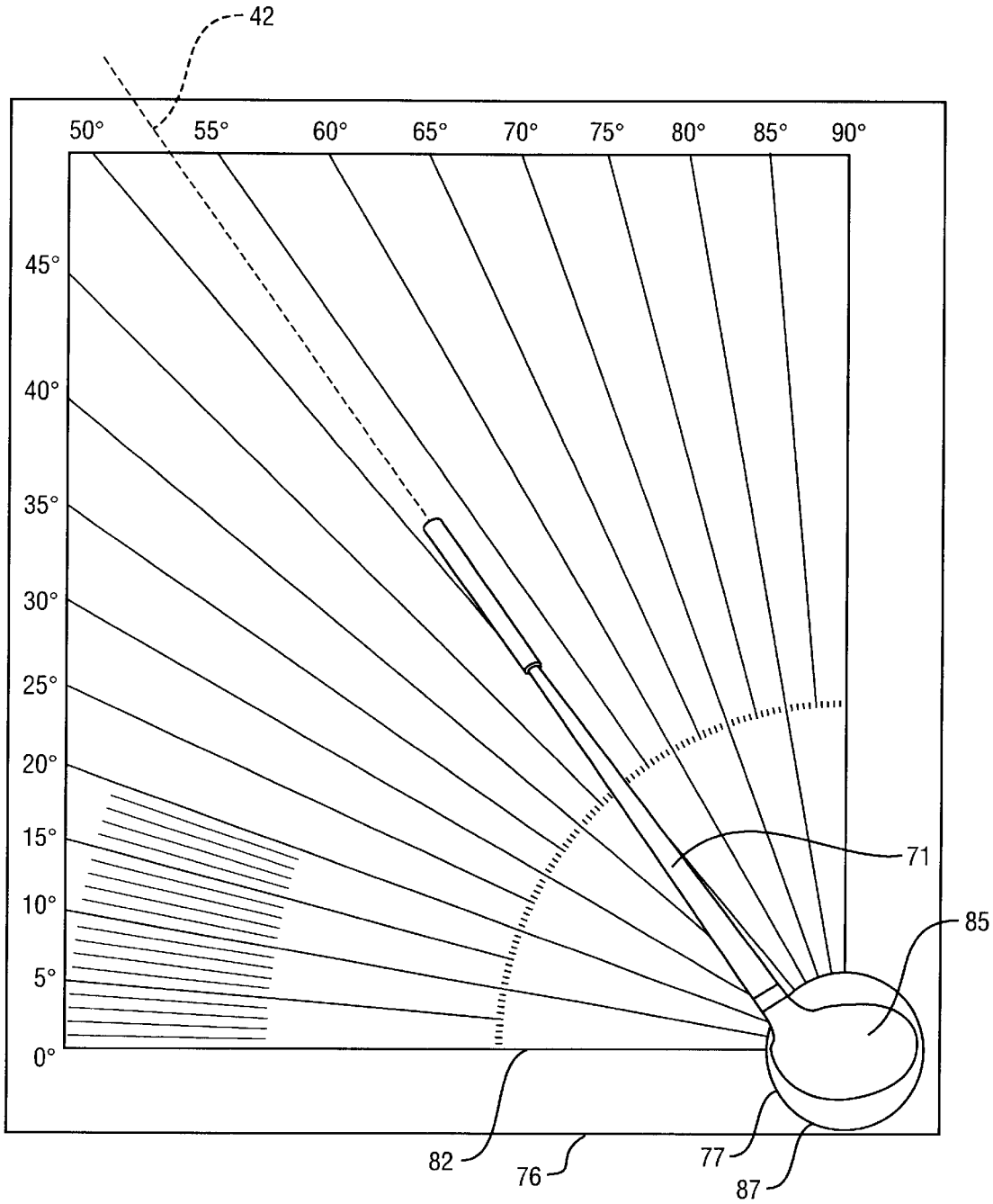
FIG. 19 shows Lie Angle Paper 82, a Golf Club 71, Level Platform 76, Sweet Line Locator 77, Donut Shaped Stabilizer Base Member 87 and Golf Club Top Surface 85. Also shown in dotted lines is Shaft Grip Centerline 42. The Golf Club 71 is shown with the Shaft Grip Centerline 42 at the angle of intended use.
Figure 20:
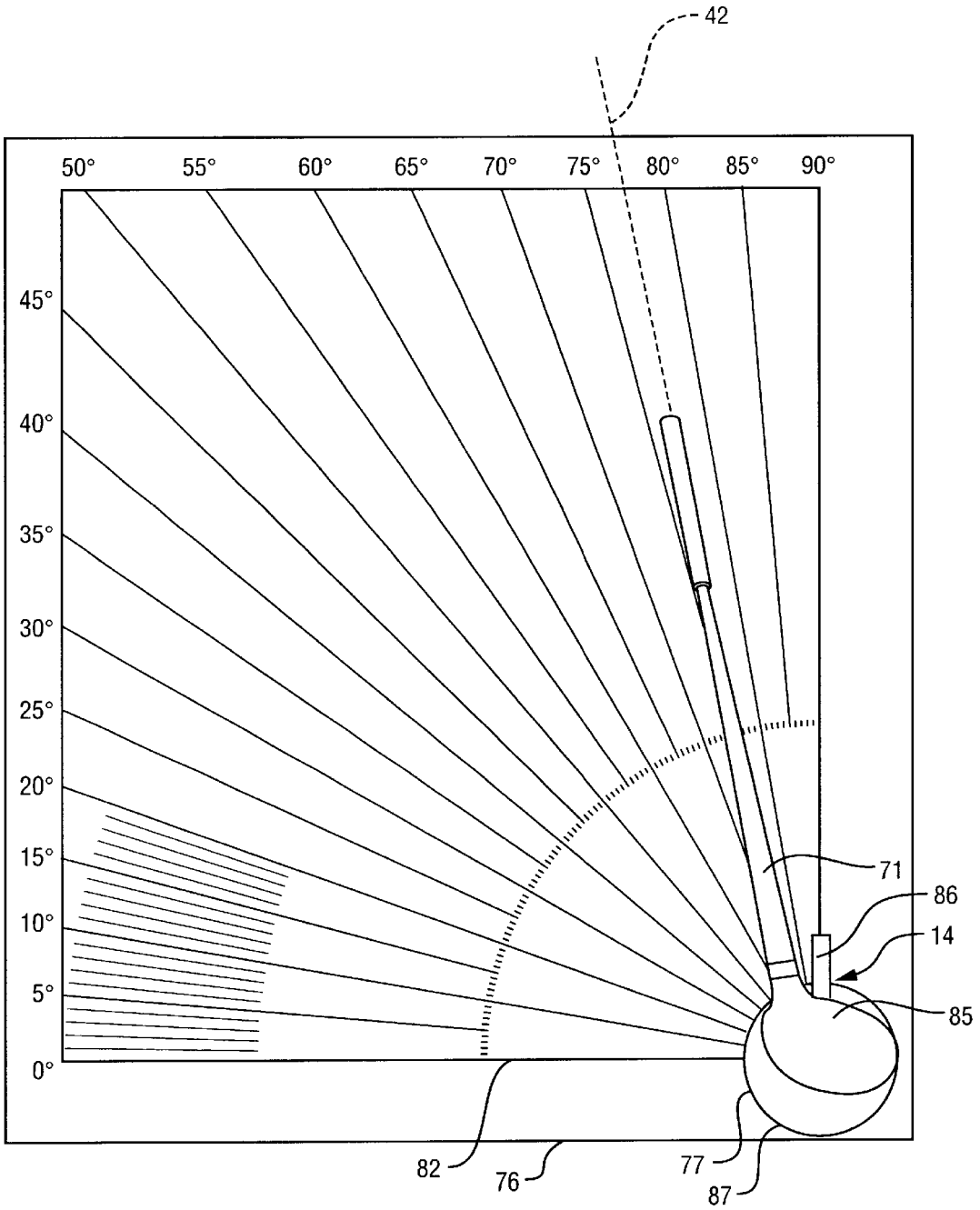
FIG. 20 shows Lie Angle Paper 82, a Golf Club 71, Level Platform 76, Sweet Line Locator 77, Donut Shaped Stabilizer Base Member 87, Golf Club Top Surface 85, Ground Target Line 14 and Level 86. Also shown in dotted lines is Shaft Grip Centerline 42. The Golf Club 71 is shown with the Shaft Grip Centerline 42 at the angle of intended use as adjusted for parallax.

FIGS. 18, 19 and 20 illustrate the steps to create a new and improved golf club for use with a golf ball, regardless of whether the golf ball is imbedded in the ground, partially imbedded in the ground, resting on the ground, resting on a tee, or any position within the range of being imbedded in the ground to resting on a tee. The first step requires a golf club having a shaft, a grip and a head, said head having a top surface, face surface, and bottom base surface, said golf club having a center of mass for the combined shaft, grip and head. The golf club head top surface has markings indicating golf club to golf ball alignment for the intended direction of the golf ball. In addition the golf club head face surface has markings indicating ideal contact points for impact with the golf ball regardless of whether the golf ball is imbedded in the ground, partially imbedded in the ground, resting on the ground, resting on a tee, or any position within the range of being imbedded in the ground to resting on a tee. The position of the golf club head top surface markings and golf club head face surface markings are determined by the following method:

a.) first, prepare a level working surface being a level platform with a hole therein, the level platform being of sufficient size to accommodate a complete golf club having a shaft, the shaft having a center line, grip and head, the golf club grip having a top end, the golf club head having a top surface, face surface, and bottom base surface;

b.) next, obtain a Sweet Line Locator 77, said Sweet Line Locator having a donut shaped stabilizer base member said stabilizer base member having a flat bottom surface, a top surface, a continuous opening of uniform diameter running from the flat bottom surface to the top surface and with a frictional devise positioned at the top surface at the continuous opening of uniform diameter, said Sweet Line Locator further having a rigid rod of sufficient diameter to engage frictionally within the continuous opening of uniform diameter and also being of sufficient length to extend both above and below the stabilizer base member said rigid rod having an upward end and a downward end and a center line;

c.) next, place the Sweet Line Locator 77 on the level platform with the rigid rod extending both downward thru the hole in the level platform and upward above the top surface of the stabilizer base member;

d.) next, place golf club with grip top end on level platform and golf club head face surface on upward end of the rigid rod;

e.) next, adjust the position of the rigid rod in order that the golf club head face is parallel to the level platform;

f.) next, adjust the point of contact of the golf club face surface and rigid rod until the golf club balances and mark the balance point of contact on the golf club face surface;

g.) next, repeat the previous step at least one more time to obtain at least one more balance point of contact;

h.) next, remove the golf club from the rigid rod, connect the points to form a line, referred to earlier as the Sweet Line, or series of points extending diagonally across the golf club face surface;

i.) next, position the golf club in the position of intended use, said position of intended use being that position when the shaft center line is at a predetermined angle with the ground, and transpose the desired impact point golf ball heights, said desired impact point golf ball heights including but not limited to one for a ball resting on the ground, and one for a ball resting on a tee, onto the golf club face surface using lines or series of points that are parallel to the desired ground surface;

j.) next, mark the intersections of the diagonal line, Sweet Line, or points with the parallel lines or points, two of which have been referred to earlier as the Ground Sweet Spot and Tee Sweet Spot;

k.) next, obtain a sheet of lie angle paper 82, as shown in FIG. 18, said lie angle paper being rectangular with a base corner forming ninety degrees and with lines radiating therefrom at a plurality of marked angles with the smallest being zero degrees and the largest being ninety degrees;

l.) next, place the lie angle paper with the base corner over the hole in the level platform;

m.) next, place sweet line locator on the level platform with the center line and downward end of the rigid rod making contact with the base corner of the lie angle paper;

n.) next, with the golf club head face surface again placed on the upward end of the rigid rod, and as before adjust the rigid rod in order for the face surface to be parallel to the level platform, position the rigid rod at the intersection of the diagonal line, Sweet Line, with the horizontal line that represents the desired impact point golf ball height marked on the golf club head face surface for a ball resting on the ground, the Ground Sweet Spot. As shown in FIG. 19, radially adjust the center line of the shaft to be at the angle that is the degrees indicated on the lie angle paper that corresponds to the position of intended use, lie angle, for the golf club involved, the golf club face surface being kept in contact with the upward end of the rigid rod, o.) next, as shown in FIG. 20, further radially adjust the center line of the shaft to be at the angle that is the degrees indicated on the lie angle paper that corresponds to the position of intended use increased by a parallax angle adjustment, said parallax angle adjustment being a predetermined angle dependent on the golf club and player, the golf club face surface being kept in contact with the upward end of the rigid rod;

p.) next, using a level that indicates a true vertical position the level at the ninety degree line on the lie angle paper and place against the golf club top surface, mark the club top surface with a line indicating the Ground Target Line being in the desired direction of movement of the golf ball;

q.) next, repeat steps n. o. and p. with the rigid rod positioned at the intersection of the diagonal line and the horizontal line for a ball resting on a tee indicating the Tee Target Line; and r.) finally, fill in the area on the golf club top surface between the lines with color that contrasts to the remaining golf club top surface, referred as top identification Target Line.

Figure 22:
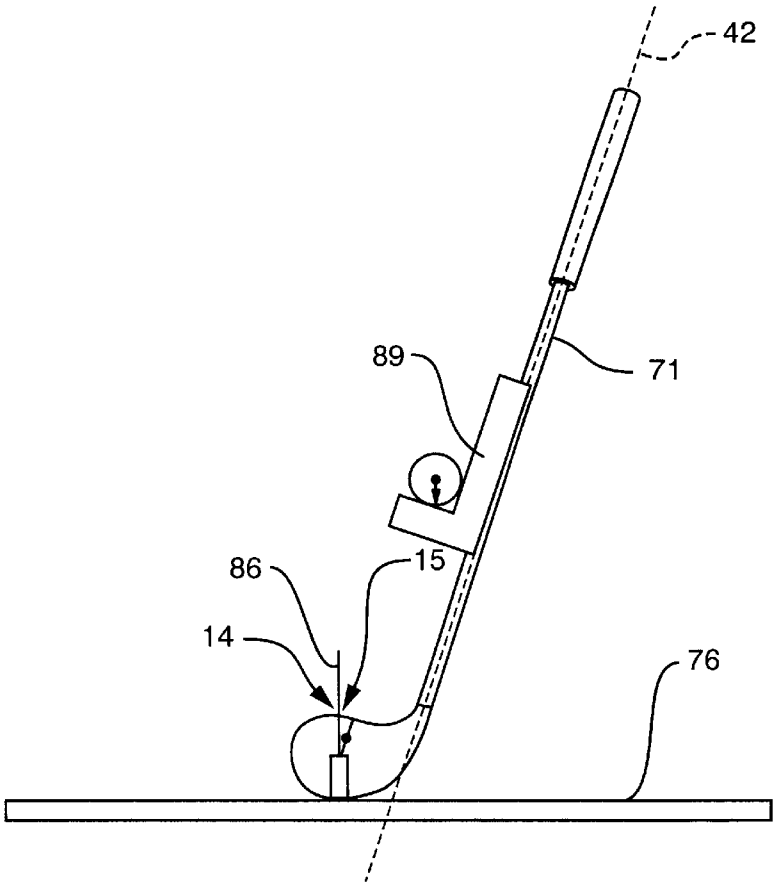
FIG. 22 shows Golf Club 71, Level Surface 76, Instrument That Reads The Angle Of Slope Above The Horizontal 89, Level 86, Ground Target Line 14 and Tee Target Line 15. Also shown in dotted lines is Shaft Grip Centerline 42. The Golf Club is shown at the angle of intended use as increased for parallax.
Figure 21:
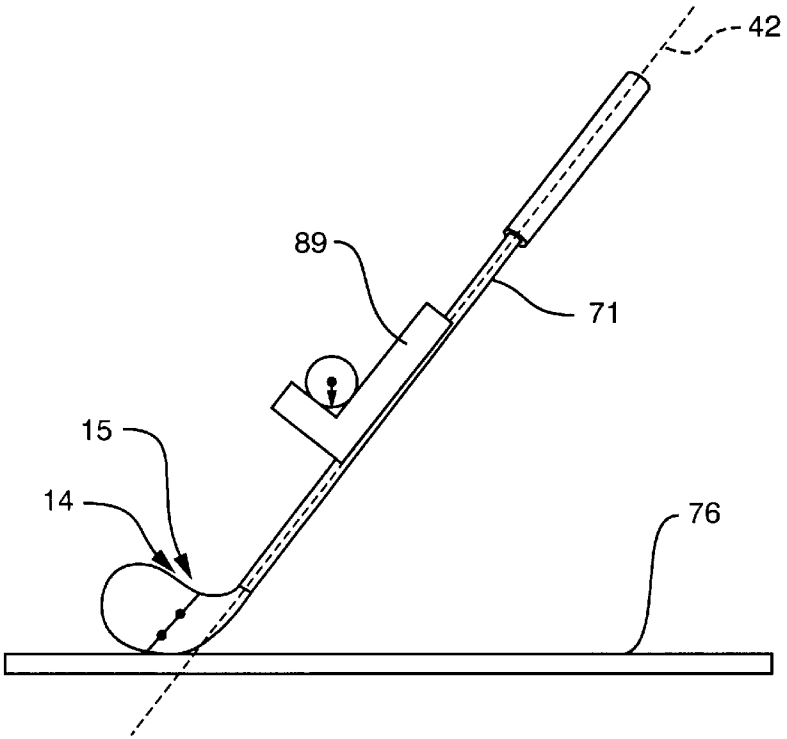
FIG. 21 shows Golf Club 71, Level Surface 76, Instrument That Reads The Angle Of Slope Above The Horizontal 89, Ground Target Line 14 and Tee Target Line 15. Also shown in dotted lines is Shaft Grip Centerline 42. The Golf Club is shown at the angle of intended use.
Figure 23:
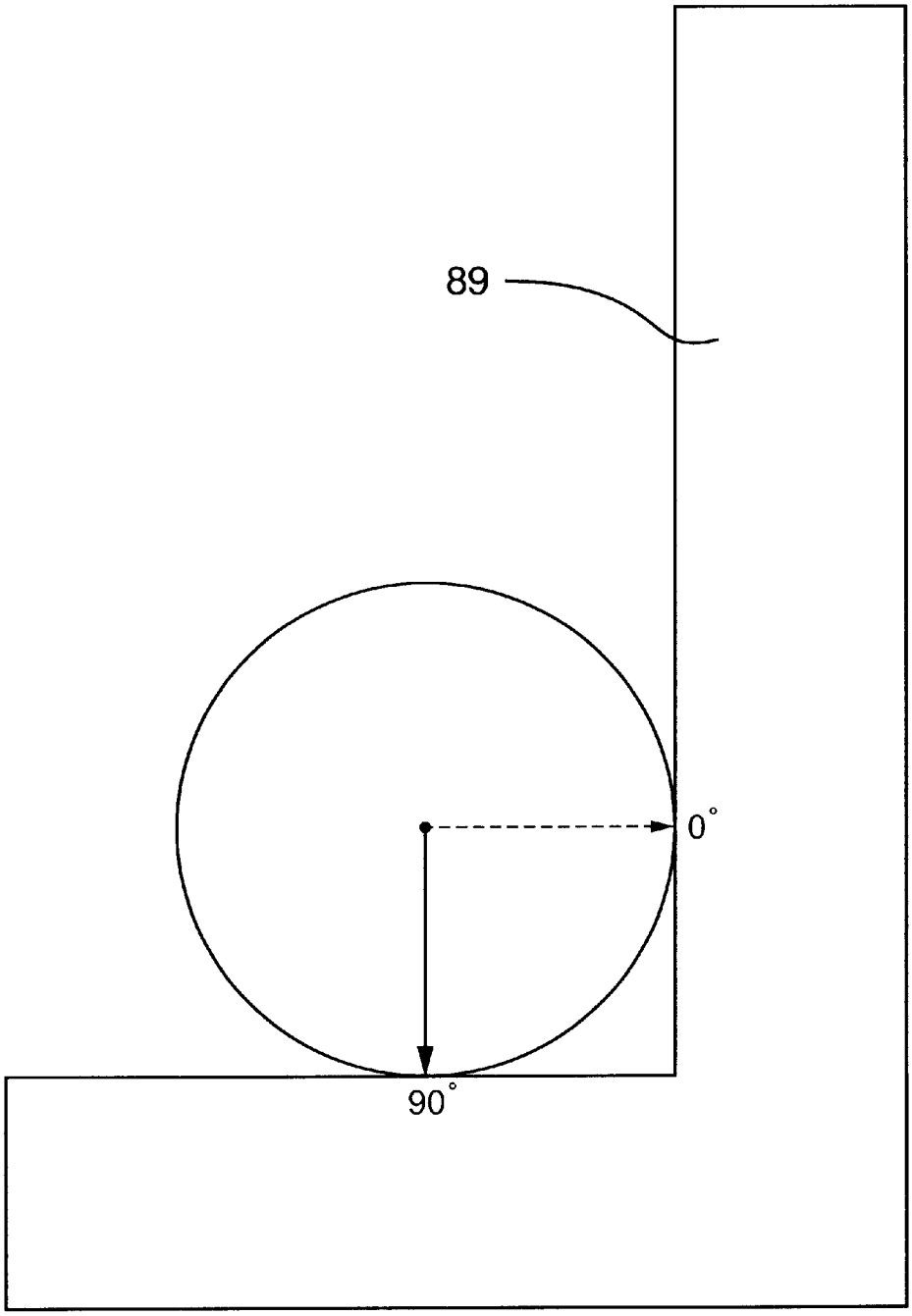
FIG. 23 shows the Instrument That Reads The Angle Of Slope Above The Horizontal 89. As shown this is a standard instrument readily available on the market. The instrument will read 90 degrees when the long shaft is vertical and 0 degrees when the long shaft is horizontal.

As shown in FIGS. 21 and 22, it is also possible to determine the location of multiple sweet spots and Target Line on a golf club by performing the preceding steps, and the following additional steps:

s.) next, obtain an instrument 89, as shown in FIG. 23, that reads the angle of slope above the horizontal, place the instrument aligned with the golf club shaft centerline with the golf club in the position of intended use;

t.) next, increase the angle of the golf club shaft centerline an amount equal to the parallax correction;

u.) next, place the level against the golf club face surface at the intersection of the golf club face surface and the line on the top surface for a ball resting on the ground and draw a line on the face surface of the golf club, referred to as the Ground Target Line;

v.) next, place the level against the golf club face surface at the intersection of the golf club face surface and the line on the top surface for a ball resting on a tee and draw a line on the face surface of the golf club, referred to as the Tee Target Line; and w.) finally, fill in the area on the golf club face surface between the lines with color that contrasts to the remaining golf club face surface, referred as Target Line.

As a variation to the foregoing it is possible to have the contrasting color on the golf club top surface extend a predetermined distance beyond the two lines on the golf club top surface.

A further variation would be to have the contrasting color on the golf club top surface extend a predetermined distance beyond one of the two lines on the golf club top surface.

An additional variation would be to have the contrasting color on the golf club face surface extend a predetermined distance beyond the two lines on the golf club face surface.

A yet further variation would be to have the contrasting color on the golf club face surface extend a predetermined distance beyond one of the two lines on the golf club face surface.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I claim the following:

1. New and improved golf club for use with a golf ball, regardless of whether the golf ball is imbedded in the ground, partially imbedded in the ground, resting on the ground, resting on a tee, or any position within the range of being imbedded in the ground to resting on a tee, comprising:

a.) A golf club having a shaft, a grip and a head, said head having a top surface, face surface, and curved bottom base surface, said golf club having a center of mass for the combined shaft, grip and head;

b.) said golf club head top surface having markings indicating golf club to golf ball alignment for the intended direction of the golf ball; and c.) said golf club head face surface having markings indicating a plane which a club is balanced about when said club head face surface faces down, said markings extending diagonally across said face when said curved bottom base surface is resting on the ground with the golf club in position of intended use, indicating ideal contact points for impact with the golf ball regardless of whether the golf ball is imbedded in the ground, partially imbedded in the ground, resting on the ground, resting on a tee, or any position within the range of being imbedded in the ground to resting on a tee.

2. New and improved golf club for use with a golf ball, regardless of whether the golf ball is imbedded in the ground, partially imbedded in the ground, resting on the ground, resting on a tee, or any position within the range of being imbedded in the ground to resting on a tee, as described in claim 1 further comprising:

a. where the markings on the face surface are grooves.

3. New and improved golf club for use with a golf ball, regardless of whether the golf ball is imbedded in the ground, partially imbedded in the ground, resting on the ground, resting on a tee, or any position within the range of being imbedded in the ground to resting on a tee, as described in claim 1 further comprising:

a. where the face surface has an area that is curved and raised, said curved and raised area follows the diagonal markings.

4. New and improved golf club for use with a golf ball, regardless of whether the golf ball is imbedded in the ground, partially imbedded in the ground, resting on the ground, resting on a tee, or any position within the range of being imbedded in the ground to resting on a tee, as described in claim 1 further comprising:

a. where the face surface has an area that is curved and raised, said curved and raised area is perpendicular to the diagonal markings.

5. New and improved golf club for use with a golf ball, regardless of whether the golf ball is imbedded in the ground, partially imbedded in the ground, resting on the ground, resting on a tee, or any position within the range of being imbedded in the ground to resting on a tee, as described in claim 1 further comprising:

a. where the top surface has an area that is curved and raised, said curved and raised area follows the markings indicating golf club to golf ball alignment for the intended direction of the golf ball.

6. New and improved golf club for use with a golf ball, regardless of whether the golf ball is imbedded in the ground, partially imbedded in the ground, resting on the ground, resting on a tee, or any position within the range of being imbedded in the ground to resting on a tee, as described in claim 1 further comprising:

a. where the shaft and grip have a center line said shaft and grip center line being aligned with a specific point on the diagonal line on the face surface when the clubhead face surface is viewed from the toe of the clubhead.

7. New and improved golf club for use with a golf ball, regardless of whether the golf ball is imbedded in the ground, partially imbedded in the ground, resting on the ground, resting on a tee, or any position within the range of being imbedded in the ground to resting on a tee, as described in claim 1 further comprising:

a. where the shaft and grip have a center line said shaft and grip center line being aligned with a specific point on the diagonal line.

8. New and improved golf club for use with a golf ball, regardless of whether the golf ball is imbedded in the ground, partially imbedded in the ground, resting on the ground, resting on a tee, or any position within the range of being imbedded in the ground to resting on a tee, comprising:

a.) A golf club having a shaft, a grip and a head, said head having a top surface, face surface, and bottom base surface, said golf club having a center of mass for the combined shaft, grip and head;

b.) said golf club head top surface having markings indicating golf club to golf ball alignment for the intended direction of the golf ball;

c.) and said golf club head face surface having markings indicating ideal contact points for impact with the golf ball regardless of whether the golf ball is imbedded in the ground, partially imbedded in the ground, resting on the ground, resting on a tee, or any position within the range of being imbedded in the ground to resting on a tee; and d.) the position of said golf club head top surface markings and golf club head face surface markings being determined as follows:

i.) prepare a level working surface being a level platform with a hole therein said level platform being of sufficient size to accommodate a complete golf club having a shaft, said shaft having a center line, grip and head, said golf club grip having a top end, said golf club head having a top surface, face surface, and bottom base surface;

ii.) obtain a sweet line locator, said sweet line locator having a donut shaped stabilizer base member said stabilizer base member having a flat bottom surface, a top surface, a continuous opening of uniform diameter running from the flat bottom surface to the top surface and with a frictional devise positioned at the top surface at the continuous opening of uniform diameter, said sweet line locator further having a rigid rod of sufficient diameter to engage frictionally within the continuous opening of uniform diameter and also being of sufficient length to extend both above and below the stabilizer base member said rigid rod having an upward end and a downward end;

iii.) place the sweet line locator on the level platform with the rigid rod extending both downward thru the hole in the level platform and upward above the top surface of the stabilizer base member;

iv.) place golf club with grip top end on level platform and golf club head face surface on upward end of the rigid rod;

v.) adjust the position of the rigid rod in order that the golf club head face is parallel to the level platform;

vi.) adjust the point of contact of the golf club face surface and rigid rod until the golf club balances and mark the balance point of contact on the golf club face surface;

vii.) repeat the previous step at least one more time to obtain at least one more balance point of contact;

viii.) remove the golf club from the rigid rod, connect the points to form a line or series of points extending diagonally across the golf club face surface;

ix.) position the golf club in the position of intended use, said position of intended use being that position when the shaft center line is at a predetermined angle with the ground, and transpose the desired impact point golf ball heights, said desired impact point golf ball heights including but not limited to one for a ball resting on the ground and one for a ball resting on a tee, onto the golf club face surface using lines or series of points that are parallel to the desired ground surface;

x.) mark the intersections of the diagonal line or points with the parallel lines or points;

xi.) obtain a sheet of lie angle paper, said lie angle paper being rectangular with a base corner forming ninety degrees and with lines radiating therefrom at a plurality of marked angles with the smallest being zero degrees and the largest being ninety degrees;

xii.) place the lie angle paper with the base corner over the hole in the level platform;

xiii.) place sweet line locator on the level platform with the downward end of the rigid rod making contact with the base corner of the lie angle paper;

xiv.) with the golf club head face surface again placed on the upward end of the rigid rod, with face surface parallel to the level platform, position the rigid rod at the intersection of the diagonal line with the horizontal line that represents the desired point golf ball height for a ball resting on the ground, radially adjust the center line of the shaft to be at the angle that is the degrees indicated on the lie angle paper that corresponds to the position of intended use for the golf club involved;

xv.) further radially adjust the center line of the shaft to be at the angle that is the degrees indicated on the lie angle paper that corresponds to the position of intended use increased by a parallax angle adjustment, said parallax angle adjustment being a predetermined angle dependent on the golf club and player;

xvi.) using a level that indicates a true vertical position the level at the ninety degree line on the lie angle paper and place against the golf club top surface, mark the club top surface with a line indicating the target line being in the desired direction of movement of the golf ball;

xvii.) repeat steps xiv, xv, and xvi with the rigid rod positioned at the intersection of the diagonal line and the horizontal line for a ball resting on a tee; and xviii.) fill in the area on the golf club top surface between the lines with color that contrasts to the remaining golf club top surface.

9. New and improved method for determining the location of multiple sweet spots and target line on a golf club comprising the steps of:

a.) Prepare a level working surface being a level platform with a hole therein said level platform being of sufficient size to accommodate a complete golf club having a shaft, said shaft having a center line, grip and head, said golf club grip having a top end, said golf club head having a top surface, face surface, and bottom base surface;

b.) obtain a sweet line locator, said sweet line locator having a donut shaped stabilizer base member said stabilizer base member having a flat bottom surface, a top surface, a continuous opening of uniform diameter running from the flat bottom surface to the top surface and with a frictional devise positioned at the top surface at the continuous opening of uniform diameter, said sweet line locator further having a rigid rod of sufficient diameter to engage frictionally within the continuous opening of uniform diameter and also being of sufficient length to extend both above and below the stabilizer base member said rigid rod having an upward end and a downward end;

c.) place the sweet line locator on the level platform with the rigid rod extending both downward thru the hole in the level platform and upward above the top surface of the stabilizer base member;

d.) place golf club with grip top end on level platform and golf club head face surface on upward end of the rigid rod;

e.) adjust the position of the rigid rod in order that the golf club head face is parallel to the level platform;

f.) adjust the point of contact of the golf club face surface and rigid rod until the golf club balances and mark the balance point of contact on the golf club face surface;

g.) repeat the previous step at least one more time to obtain at least one more balance point of contact;

h.) remove the golf club from the rigid rod, connect the points to form a line or series of points extending diagonally across the golf club face surface;

i.) position the golf club in the position of intended use, said position of intended use being that position when the shaft center line is at a predetermined angle with the ground, and transpose the desired impact point golf ball heights, said desired impact point golf ball heights including but not limited to one for a ball resting on the ground and one for a ball resting on a tee, onto the golf club face surface using lines or series of points that are parallel to the desired ground surface;

j.) mark the intersections of the diagonal line or points with the parallel lines or points;

k.) obtain a sheet of lie angle paper, said lie angle paper being rectangular with a base corner forming ninety degrees and with lines radiating therefrom at a plurality of marked angles with the smallest being zero degrees and the largest being ninety degrees;

l.) place the lie angle paper with the base corner over the hole in the level platform, m.) place sweet line locator on the level platform with the downward end of the rigid rod making contact with the base corner of the lie angle paper;

n.) with the golf club head face surface again placed on the upward end of the rigid rod, with face surface parallel to the level platform, position the rigid rod at the intersection of the diagonal line with the horizontal line that represents the desired impact point golf ball height marked on the golf club head face surface for a ball resting on the ground, radially adjust the center line of the shaft to be at the angle that is the degrees indicated on the lie angle paper that corresponds to the position of intended use for the golf club involved;

o.) further radially adjust the center line of the shaft to be at the angle that is the degrees indicated on the lie angle paper that corresponds to the position of intended use increased by a parallax angle adjustment, said parallax angle adjustment being a predetermined angle dependent on the golf club and player;

p.) using a level that indicates a true vertical position the level at the ninety degree line on the lie angle paper and place against the golf club top surface, mark the club top surface with a line indicating the target line being in the desired direction of movement of the golf ball;

q.) repeat steps n, o, and p with the rigid rod positioned at the intersection of the diagonal line and the horizontal line for a ball resting on a tee; and r.) fill in the area on the golf club top surface between the lines with color that contrasts to the remaining golf club top surface.

10. New and improved method for determining the location of multiple sweet spots and target line on a golf club comprising the steps of as claimed in claim 9 where the contrasting color on the golf club top surface extends a predetermined distance beyond the two lines on the golf club top surface.

11. New and improved method for determining the location of multiple sweet spots and target line on a golf club comprising the steps of as claimed in claim 9 where the contrasting color on the golf club top surface extends a predetermined distance beyond one of the two lines on the golf club top surface.

12. New and improved method for determining the location of multiple sweet spots and target line on a golf club comprising the steps of as claimed in claim 9, and the following additional step:

s.) obtain an instrument, that reads the angle of slope above the horizontal, place the instrument aligned with the golf club shaft centerline with the golf club in the position of intended use;

t.) increase the angle of the golf club shaft centerline an amount equal to the parallax correction;

u.) place the level against the golf club face surface at the intersection of the golf club face surface and the line on the top surface for a ball resting on the ground and draw a line on the face surface of the golf club;

v.) place the level against the golf club face surface at the intersection of the golf club face surface and the line on the top surface for a ball resting on a tee and draw a line on the face surface of the golf club; and w.) fill in the area on the golf club face surface between the lines with color that contrasts to the remaining golf club face surface.

13. New and improved method for determining the location of multiple sweet spots and target line on a golf club comprising the steps of as claimed in claim 12 where the contrasting color on the golf club face surface extends a predetermined distance beyond the two lines on the golf club face surface.

14. New and improved method for determining the location of multiple sweet spots and target line on a golf club comprising the steps of as claimed in claim 12 where the contrasting color on the golf club face surface extends a predetermined distance beyond one of the two lines on the golf club face surface.

* * * * *